US006846064B2

(12) United States Patent
Yamane

(10) Patent No.: US 6,846,064 B2
(45) Date of Patent: Jan. 25, 2005

(54) RECORDING HEAD AND RECORDING APPARATUS HAVING RECORDING HEAD

(75) Inventor: Toru Yamane, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/411,326

(22) Filed: Apr. 11, 2003

(65) Prior Publication Data

US 2004/0021730 A1 Feb. 5, 2004

(30) Foreign Application Priority Data

Apr. 12, 2002 (JP) ..... 2002-111268

(51) Int. Cl.[7] ..... B41J 2/145; B41J 2/15
(52) U.S. Cl. ..... 347/40; 347/41
(58) Field of Search ..... 347/40, 19, 12, 347/9

(56) References Cited

U.S. PATENT DOCUMENTS

| | | | | |
|---|---|---|---|---|
| 5,030,317 A | | 7/1991 | Noguchi | 216/27 |
| 5,640,183 A | * | 6/1997 | Hackleman | 347/40 |
| 5,923,348 A | | 7/1999 | Cunnagin et al. | 347/42 |
| 6,312,099 B1 | | 11/2001 | Hawkins et al. | 347/42 |
| 6,394,579 B1 | * | 5/2002 | Boyd et al. | 347/47 |
| 2002/0060715 A1 | | 5/2002 | Karita et al. | 347/42 |

FOREIGN PATENT DOCUMENTS

| | | |
|---|---|---|
| JP | 62-253457 | 11/1987 |
| JP | 5-57965 | 3/1993 |
| JP | 2000-289233 | 10/2000 |

* cited by examiner

*Primary Examiner*—Thinh Nguyen
(74) *Attorney, Agent, or Firm*—Fitzpatrick, Cella, Harper & Scinto

(57) ABSTRACT

A recording head includes a first ejection outlet array having a plurality of ejection outlets for ejecting liquid; a second ejection outlet array having a plurality of ejection outlets for ejecting liquid, the second ejection outlet array extending along a direction in which the first ejection outlet array extends such that second ejection outlet array is not overlapped with the first ejection outlet array in the direction or a direction perpendicular to the direction, wherein an end portion of the first ejection outlet array is disposed to an end of the second ejection outlet array; and a plurality of supplementing ejection outlets disposed close to at least one of the end portions or the first ejection outlet array and the second ejection outlet array such that supplementing ejection outlets are overlapped with another one of the end portions in the direction in which the first ejection outlet array extends, wherein the supplementing ejection outlets are disposed at an interval which is different from an interval at which the ejection outlets of the first ejection outlet array are disposed.

7 Claims, 27 Drawing Sheets

RECORDING HEAD AND RECORDING APPARATUS HAVING RECORDING HEAD

FIELD OF THE INVENTION AND RELATED ART

The present invention relates to a recording head which ejects recording liquid onto the recording surface of recording medium to carry out a recording operation, and a recording apparatus equipped with such a recording head.

Ink jet recording head units can be categorized into roughly two types: a "side shooter type" as shown in FIG. 23, and an "edge shooter" type as shown in FIG. 26. FIG. 23 shows a part of an ink jet recording head unit of the "side shooter" type, which is disposed in such a manner that the surface having ejection orifices squarely faces the recording surface of the recording medium.

The ink jet recording head unit has a supporting member 2, a set of head chips 6A, and a set of head chips 6B. The supporting member 2 is positioned on the main assembly side of a recording apparatus. Each of the heads chips 6A and 6B has a plurality of ink ejection orifices. The head chips 6A are disposed on one side of the flat surface of the supporting member 2, and the head chips 6B are disposed on the other.

More specifically, the plurality of head chips 6A are aligned, for example, in the direction perpendicular to the direction, indicated by an arrow mark S, in which the ink jet recording head, which carries out a recording operation, is moved, and so are the plurality of head chips 6B. The head chips 6A are disposed with the provision of a predetermined interval between the adjacent two head chips 6A, and so are the head chips 6B. The line in which the head chips 6A are aligned is roughly parallel to the line in which the head chips 6B are aligned. Further, the set of head chips 6A and the set of head chips 6B are positioned so that the position of each head chip 6B corresponds to the position of the interval between the two head chips 6A adjacent to this head chip 6B, while the position of each head chip 6A corresponds to the position of the interval between the two head chips 6B adjacent to this head chip 6A. In other words, the set of head chips 6A and set of head chips B are offset relative to each other in the direction in which the head chips are aligned, so that the head chips 6A and head chips 6B are arranged in the zigzag fashion. Further, the head chips 6A and head chips 6B are disposed in the recesses, one for one, of the aforementioned flat surface of the supporting member 2, being fixed thereto. In each recess, there is the opening of one of the ink supply paths leading to the common ink chamber, from which ink is supplied to the head chips 6A and head chips 6B.

Essentially, each of the head chips 6A and 6B comprises: an ejection clement substrate, and a grooved plate. The ejection element substrate has a plurality of electrothermal transducers, as an ejection energy generation member, arranged with the provision of predetermined intervals. The grooved plate has a plurality of grooves and a recess, which are precisely positioned across one of its surfaces. As the grooved plate is laid on the ejection element substrate, a plurality of branches of liquid paths leading one for one to the ejection orifices, and the common liquid chamber from which the plurality of branches of liquid paths originate, are formed.

Each of the head chips 6A and 6B is relatively precisely positioned with the use of the image processing technologies, for examples. Each head chip 6A (6B) has a plurality of electrothermal transducers disposed, one for one, in the liquid paths leading to the ink ejection orifices, one for one, for example, and are electrically connected to the wiring substrate 4A (4B) surrounding the ejection element substrate.

The grooved plate has a plurality of ejection orifices, which squarely oppose, one for one, the electrothermal transducers on the ejection element substrate, in terms of the direction parallel to the thickness direction of the electrothermal transducers. Each head chip 6A has ejection orifices 8*ai* (i=1–n, n being integer), and each head chip 6B has ejection orifices 8*bi* (i=1–n, n being integer). The ejection orifices are aligned, for example, in two lines which are approximately parallel to each other, so that the ejection orifices in one line are offset relative to the corresponding ejection orifices in the other line; in other words, they are positioned in the zigzag manner, as shown in FIG. 24(A).

With the provision of the above described structural arrangement, as a driving signal is supplied to any of the electrothermal transducers on the ejection element substrate, through the wiring substrates 4A or 4B, the body of ink surrounding this electrothermal transducer, in the corresponding branch of ink path, instantly boils, generating pressure. As a result, liquid droplets are ejected from the ejection orifice 8*ai* or 8*bi*, corresponding to this electrothermal transducer, in the direction indicated by the arrow marks in FIG. 23, forming image regions GA and GB on the recording surface of recording medium, as shown in FIG. 25(A). The image region GA. In FIG. 25(A) is formed by the Ink droplets ejected from one of the head chips 6A as it is moved relative to the recording surface of the recording medium in the arrow direction S, and the image region GB is formed by the ink droplets ejected from one of the head chips B as it is moved relative to the recording surface of the recording medium in the arrow direction S. The image region GA is made up of a set of a plurality of picture elements (dots) IDA, each of which was formed by the ink droplet which landed on, and adhered to, one of the predetermined points on the recording surface of the recording medium, and the image region GB is made up of a set of a plurality of picture elements (dots) IDB, each of which was formed by the ink droplet which landed on, and adhered to, one of the predetermined points on the recording surface of the recording medium.

On the other hand, FIG. 26 shows a portion of an ink jet recording head of the "edge shooter" type, which is disposed in such a manner that its surface having the ejection orifices squarely faces the recording surface of the recording medium.

The ink jet recording head unit has a supporting plate 10, a plurality of head chips 12A, and a plurality of head chips 12B. The supporting plate 10 is mounted into the main assembly of a recording apparatus, being accurately positioned therewith. Each of the head chips 12A and 12B has a plurality of ink ejection orifices. The head chips 12A are disposed on one of the larger flat vertical surfaces of the supporting plate 10, being flush with the top surface of tile supporting plate 10, and the head chips 12B are disposed on the other of the larger flat surfaces of the supporting plate 10, being also flush with the top surface of the supporting plate 10. More specifically, the plurality of bead chips 12A are aligned, for example, In the direction perpendicular to the direction, indicated by an arrow mark S, in which the ink jet recording head, which carries out a recording operation, is moved, and so are the plurality of head chips 12B. The head chips 12A are disposed with the provision of a predetermined interval between the adjacent two head chips 12A, and so are the head chips 12B. The line in which the head chips 12A are aligned is parallel to the line in which the head chips 12B are aligned. In terms of the positional relationship between the head chip 12A and head chip 12B, the head chips 12A and head chips 12B are disposed so that, in terms of the direction perpendicular to the moving direction of the ink jet recording head unit, each head chip 12B faces the interval between the two head chips 12B adjacent to this head chip 12A; in other words, the head chips 12A and head chips 12B are disposed in the so-called zigzag pattern. The head chips 12A and head chips 12B are relatively precisely positioned with the use of image processing technologies, for example.

Since a head chip 12A and a head chip 12B are the same in structure, only the head chip 12A will be described; the head chip 12B will not be described.

For example, each head chip 12A comprises an ejection element substrate 14A, a liquid path formation member 16A, and a top plate 18A. The top plate 18A will be described later. The ejection element substrate 14A has a plurality of electrothermal transducers, which will be described later, and is attached to one of the aforementioned larger vertical flat surfaces of the supporting plate 10. The liquid path formation member 16A forms, in cooperation with the top plate 18A, a plurality of ink paths leading, one for one, to the plurality of the ejection orifices of the recording element substrate 14, and a common liquid chamber. The top plate 18A is attached to the top surface of the liquid path formation member 18A to cover the liquid path formation member 16A.

The recording element substrate 14A is formed of a plate of silicon (Si), glass, ceramic, aluminum, aluminum alloy, or the like. On the surface of the recording element substrate 14, there are a plurality of heater layers, as electrothermal transducers, which correspond in position to the plurality of ink paths, one for one, and a plurality of wiring layers. The heater layers and wiring layers are formed in the form of film, in predetermined patterns, with the use of photolithographic technologies. The heater layers, etc., on the recording element substrate 14A are in electrical connection with the control section, which sends out drive control signals to the heater layers.

The liquid path formation member 16A has a plurality of ejection orifices 16*ai* (i=1–n, n being integer), which are in connection to the ink paths, one for one, and which open at the top surface of the liquid path formation member 16A, being aligned in the direction roughly perpendicular to the direction indicated by an arrow mark S. The top plate 18A is in connection to one end of each of the ink supply paths, which is not shown in the drawing. With the provision of the above described setup, the ink supplied through the ink supply path is supplied to the common liquid chamber connected to each of the ink paths.

The liquid path formation member 16A and top plate 18A placed in layers on the recording element substrate 14A are made with the use of a photolithographic means, the method for airtightly adhering a molded top plate having nozzles, onto the recording element substrate 1, or the like, as shown in Japanese Laid-open Patent Application 62-253457.

With the provision of the above described structural arrangement, as driving signals are supplied to the heater layers of recording element substrate 14A, the body of ink surrounding each healer layer, in the corresponding ink path, instantly boils, generating pressure. As a result, liquid droplets are ejected from the ejection orifice 16*ai* in the direction indicated by the arrow-marks in FIG. 26, forming image regions GA and GB on the recording surface of recording medium, as shown in FIG. 28(A). The image region GA in FIG. 28(A) is formed by the ink droplets ejected from one of the head chip 12A as this head chip 12A is moved in the arrow direction S, and the image region GB is formed by the ink droplets ejected from one of the head chips B as this head chip B is moved in the arrow direction S. The image region GA is made up of a plurality of picture elements (dots) IDA, each of which was formed by the ink droplet which landed on, and adhered to, one of the predetermined points on the recording surface of the recording medium, and the image region GB is made up of a plurality of picture elements (dots) IDB, each of which was formed by the ink droplet which landed on, and adhered to, one of the predetermined points on the recording surface of the recording medium.

However, when a large number of recording head units of the "side shooter" type, or the "edge shooter" type, are manufactured with one of the above mentioned methods, manufacture errors sometimes occur due to various causes, resulting in the production of such recording head units in which the distance PG between the last (first) ejection orifice of a given head chip 6A (12A) on one side of the supporting member (plate), and the first (last) ejection orifice of the head chip 6B (12B) on the other side of the supporting member (plate), in terms of the direction ill which the ejection orifices are aligned, is different from the predetermined distance (pitch) PR, that is, the correct distance.

The correct distance (pitch) PR shown In FIG. 24(A), and the correct distance (pitch) PR shown in FIG. 27(A), are the same as the distance (pitch) P1 between the adjacent two ejection orifices of tile head chip 6A (12A), and the distance (pitch) P1 between the adjacent two ejection orifices of the head chip 6B (12B), respectively. Thus, the recording density per unit length in the direction perpendicular to the scanning direction of the recording head unit is determined by the ejection orifice density in the same direction. In other words, it becomes identical to the pitch P1.

When the PG is different from the correct distance PR, for example, when the distance PG is greater than the correct distance PR (PG>P1) as shown in FIG. 24(B), a gap, that is, a white streak WL, the width of which is proportional to the difference between the distance PG and correct distance PR, is sometimes formed between the image region GA made up of the set of dots IDA formed by a given head chip 6A, and the image region GB made up of the set of dots IDB formed by the head chip 6B adjacent to the given head chip 6A, as shown in FIG. 25(B).

The above described phenomenon also occurs to a recording head unit of the "edge shooter" type having the head chips 12A and 12B. That is, when the aforementioned distance PG is greater than the correct distance PR (PG>P1), as shown in FIG. 27(B), a gap, that is, a white streak WL, the width of which is proportional to the difference between the distance PG and correct distance PR, is sometimes formed between the image region GA made up of the set or dots IDA formed by a given head chip 12A, and the image region GB made up of the set of dots IDB formed by the head chip 12B adjacent to the given head chip 12A, as shown in FIG. 28(B). In other words, the ink droplets deviate in terms of landing spot, significantly contributing to the formation of an inferior image.

On the other hand, when the distance PS is smaller than (PS<P1) as shown in FIG. 24(C), the image region GA" made up of the set of dots IDA formed by a given head chip 6A, and the image region GB" made up of the set of dots IDB formed by the head chip 6B adjacent to the given head chip 6A, slightly overlap with each other, creating a black streak BL, as shown in FIG. 25(C).

This phenomenon also occurs to a recording head unit of the "edge shooter" type having the head chips 12A and 12B, creating the so-called black streak.

Obviously, the above described black streak also significantly contributes to the formation of an inferior image.

SUMMARY OF THE INVENTION

Accordingly, it is a principal object of the present invention to provide a recording head and a recording apparatus, wherein even if there is a deviation between an array of liquid ejection outlets and another array of liquid ejection outlets, the quality of the image provided by the ejection outlets is not deteriorated.

According to an aspect of the present invention, there is provided a recording head and a recording apparatus which includes a first ejection outlet array having a plurality of ejection outlets for ejecting liquid; a second ejection outlet array having a plurality of ejection outlets for ejecting liquid, the second ejection outlet array extending along a direction in which the first ejection outlet array extends such that second ejection outlet array is not overlapped with the first ejection outlet array in the direction or a direction perpendicular to the direction, wherein an end portion of the first ejection outlet array is disposed to an end of the second ejection outlet array: and a plurality of supplementing ejection outlets disposed close to at least one of the end portions of the first ejection outlet array and the second ejection outlet array such that supplementing ejection outlets are overlapped with another one of the end portions in the direction in which the first ejection outlet array extends, wherein the supplementing ejection outlets are disposed at an interval which is different from an interval at which the ejection outlets of the first ejection outlet array are disposed.

These and other objects, features, and advantages of the present invention will become more apparent upon consideration of the following description of the preferred embodiments of the present invention, taken In conjunction with the accompanying drawings.

DESCRIPTION OF THE PREFERRED EMBODIMENTS

Figure 1:
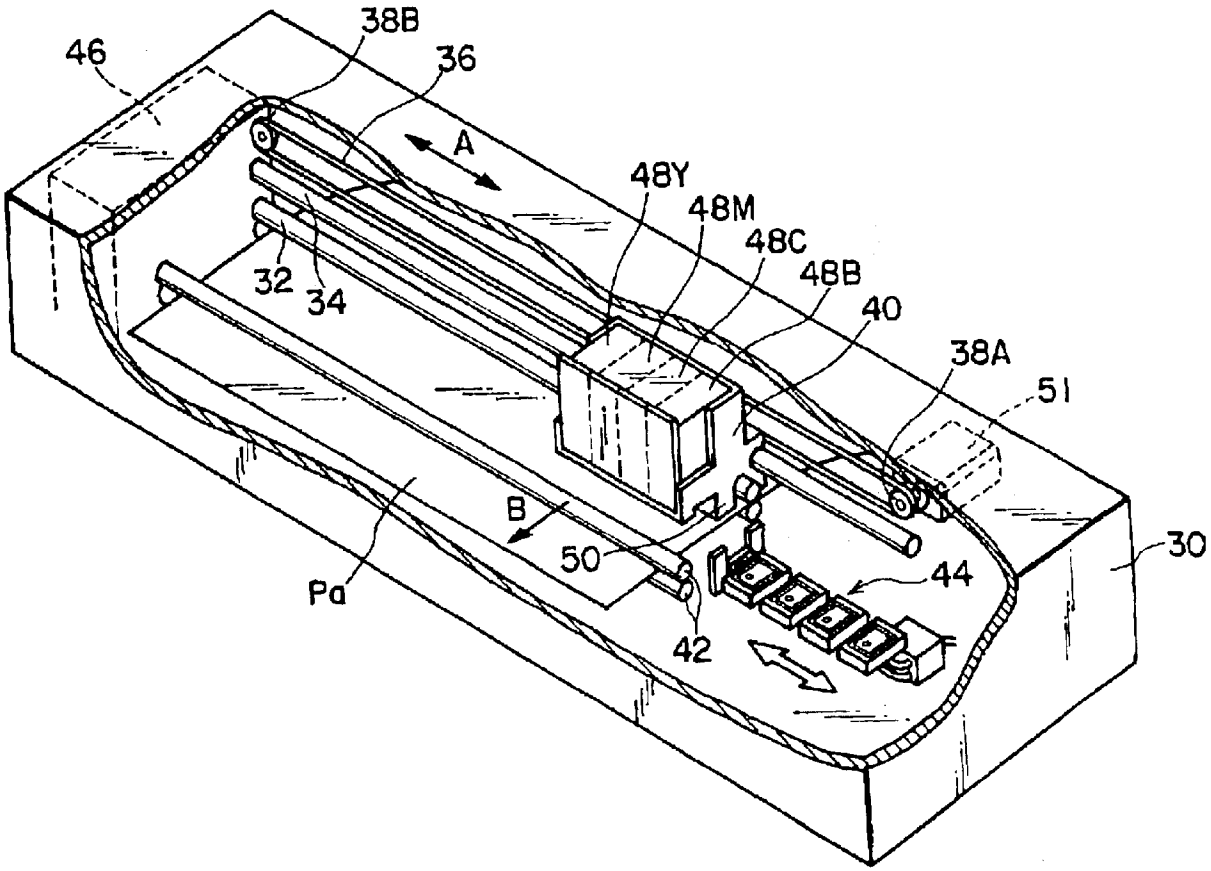
FIG. 1 is a perspective view of an example of a recording apparatus equipped with a recording head in accordance with the present invention, for showing the general structure thereof.

FIG. 1 shows the first embodiment off a recording head in accordance with the present invention, and the general structure of the recording apparatus compatible with each of the embodiments of the present invention, which will be described later.

In FIG. 1, the recording apparatus essentially comprises: a recording head Unit 50, which will be described later; a carriage 40 on which a plurality of ink containers 48Y, 48M, 48C, and 48B are removably mountable; a pair of conveyance roller units 32 and 42, which intermittently convey a recording paper Pa, as a recording medium, to a location below the recording head unit 50 in the direction indicated by an arrow mark B; and a guide shaft 34, on which the carriage 40 is set, being enabled to be slidingly guided in the direction roughly perpendicular to the direction of the arrow B.

The guide shaft 34 is inserted in the end portion of the base portion of the carriage 40, supporting the carriage 34 in such a manner that the carriage 40 can be shuttled in the direction indicated by an arrow mark A. The guide shaft 34 is solidly fixed to the housing 30 by its lengthwise ends. The carriage 40 is attached to a timing belt 36 by the back side The timing belt 36 is fitted around a pair of pulleys 38A and 38B disposed a predetermined distance from each other. The pulley 38B is simply supported by the housing 30, being enable to freely rotate, whereas the pulley 38A is rotationally supported by the housing 30, and is connected to the output shaft of a driving motor 51. Thus, as the motor 51 is rotated forward or in reverse, the carriage 40 is moved forward or backward a predetermined distance by the timing belt 36.

The ink containers 48Y, 48M, 48C, and 48B are assumed to contain yellow, magenta, cyan, and black inks, respectively, by predetermined amounts. The internal pressure of each of the ink containers 48Y, 48M, 48C, and 48B is kept at a predetermined negative level.

The conveyance rollers 32 and 42 are attached to the housing 30, being thereby rotationally supported, by their lengthwise ends. The conveyance roller unit 32 is disposed on the upstream side of the conveyance roller unit 42, with the presence of a predetermined distance between two roller units 32 and 42, in terms of the direction in which the paper Pa is conveyed. To one end of each of the conveyance roller units 32 and 42, a conveyance roller unit driving portion 46, inclusive of a motor for driving the conveyance roller units 32 and 42, is connected. Thus, as the driving portion 46 is driven, the recording paper Pa is intermittently conveyed in the arrow B direction while remaining nipped by the conveyance roller units 32 and 42. Thus, while the recording paper Pa is conveyed in the above described manner, it is kept under a predetermined amount of tension, assuring that it is kept flat, across the area facing the recording head, as will be described later.

At one end of the internal space of the housing 30, the home position is located, at which the carriage 40 bearing the plurality of ink containers 48Y–48B is temporarily stopped, or is kept on standby, as necessary, with a predetermined timing, for example, at the beginning of a recording operation, or during a recording operation, and also, at which a capping member 44 for carrying out a recovery process for the recording head is located. To the capping member 44, a suction type recovery means is connected, which is for preventing the ejection orifices of the recording head unit from becoming plugged, by forcefully suctioning ink from the ejection orifices.

Figure 4:
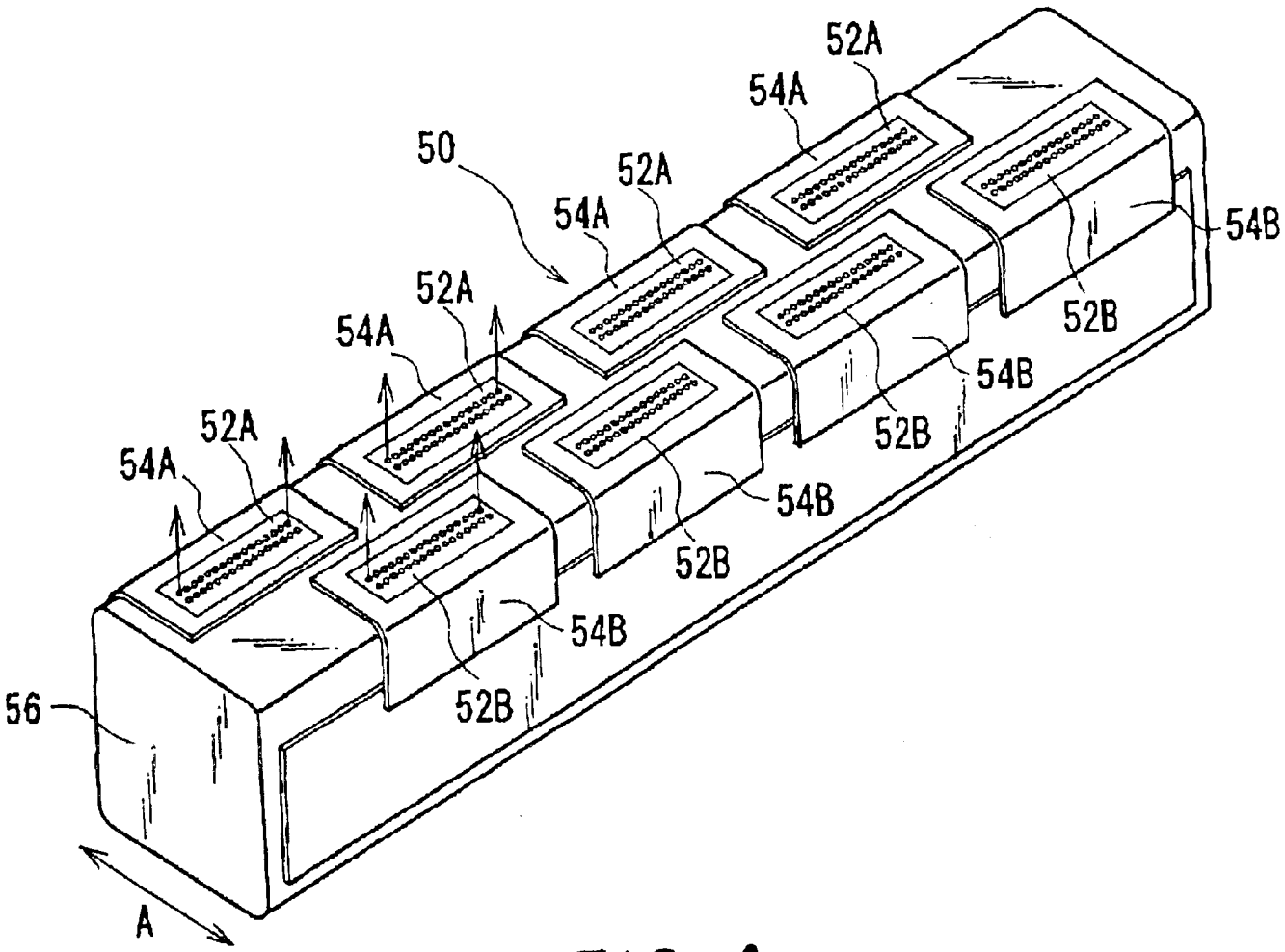
FIG. 4 is a perspective view of the essential portion of the first embodiment of a recording head in accordance with the present invention.

Each ink container is provided with its own recording head unit 50 shown in FIG. 4, and is mounted on the carriage 40 in such a manner that the ejection orifices of its recording head unit 50 squarely face the recording surface of the recording paper Pa located below the carriage 40.

The recording head unit 50 has a holder 56, a set of head chips 52A, a set of head chips 52B, a set of wiring substrate 54A, and a set of wiring substrates 54B. The holder 56 is precisely positioned by being engaged with a predetermined portion of the carriage 40. The set of head chips 52A is disposed along one edge of the top surface of the holder 56, and the set of head chips 52B is disposed along the other edge. The two sets of wiring substrates 54A and 54B are electrically connected to the set of head chips 52A and set of head chips 52B, respectively.

The head chips 52A are arranged in a straight line roughly perpendicular to the moving direction of the carriage 40, that is, the direction indicated by an arrow mark A, with the provision of a predetermined interval between adjacent two head chips 52A, arid so are the head chips 52A, with provision of the predetermined interval between the adjacent two head chips 52B. Further, the set or head chips 52A and set of head chips 52B are attached to the top surface of the holder 56, being disposed relative to each other in such a manner that the mid point of the interval between given two adjacent head chips 52A aligns with the center of the head chip 52B on the other side of the holder 56; in other words, the two sets of head chips 52A and 52B are disposed so that the head chips 52A and head chips 52B are disposed in the so-called zigzag fashion. Further, the two sets of head chips 52A and 52B are positioned with the use of a predetermined jig, with a positional tolerance of approximately ±0.1 mm.

Figure 5:
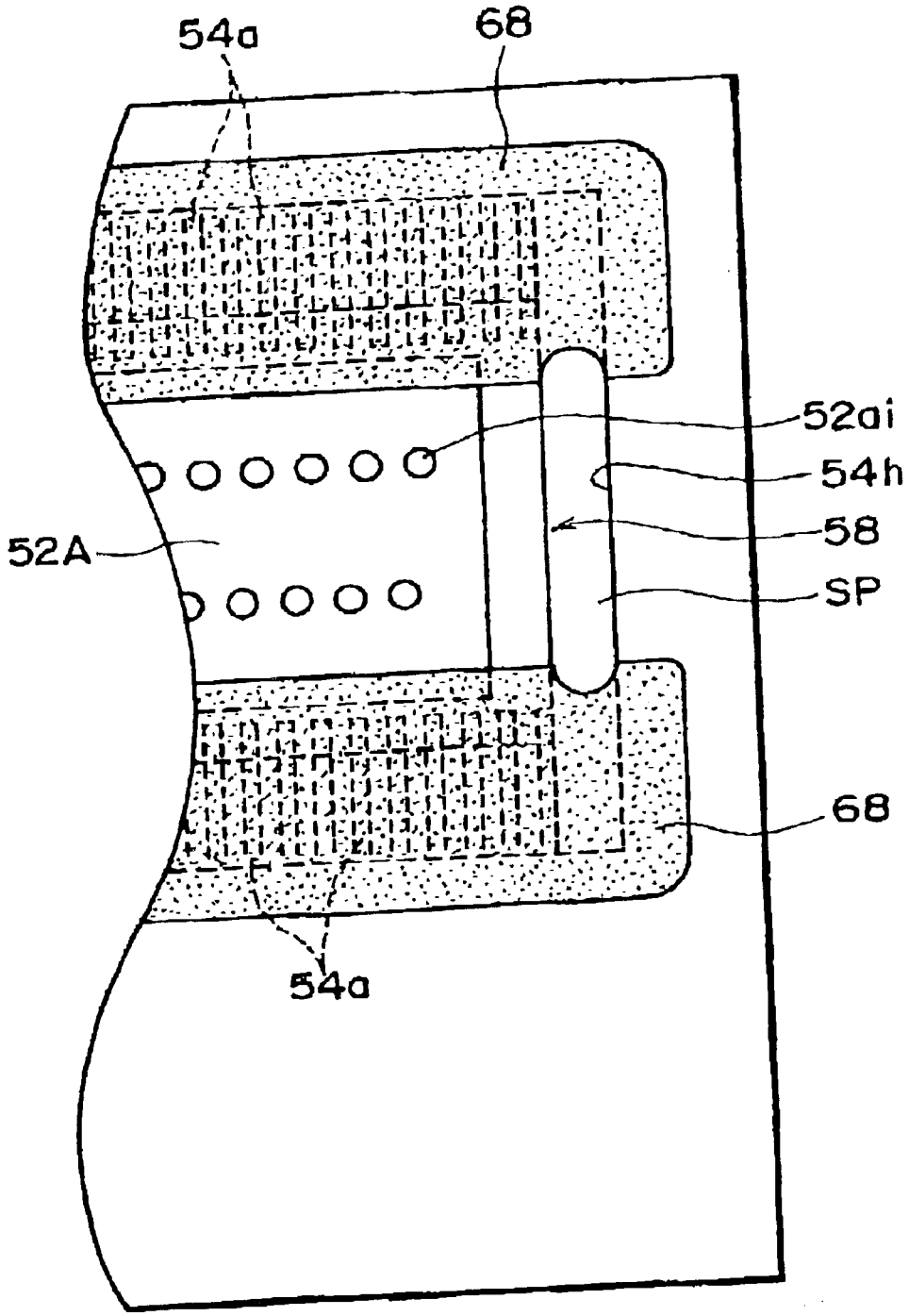
FIG. 5 is a plan view of a part of one of the head chips of the recording apparatus in FIG. 1.
Figure 7:
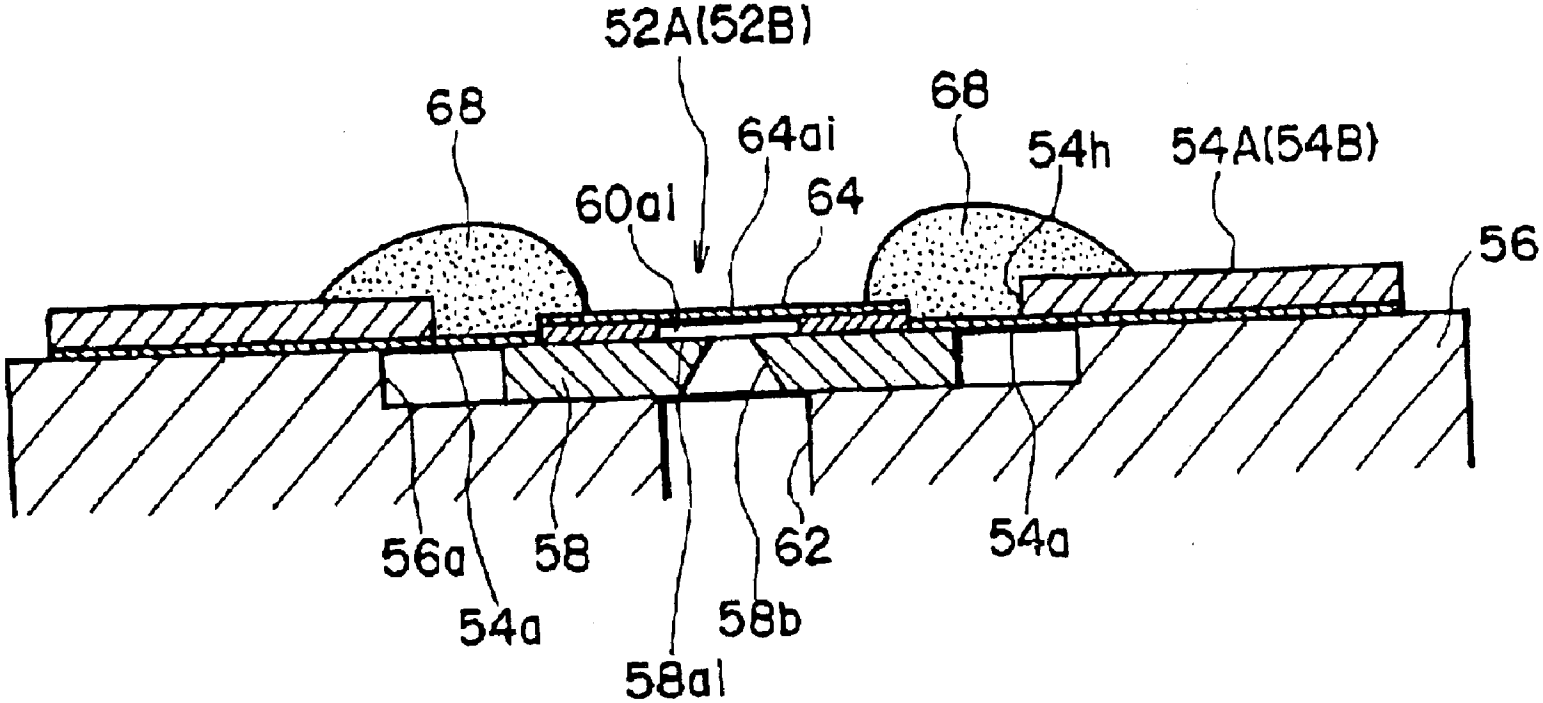
FIG. 7 is a sectional view of another part of the portion of the head chip in FIG. 5.

Referring to FIGS. 5 and 7, each head chip 52A essentially comprises an ejection element substrate 58, and a grooved plate 64. The ejection element substrate 58 has a plurality of electrothermal transducers 58*ai* (i=1–n, n being integer), as heaters, that is, ejection energy generating portions, arranged across one of its surface, with the presence of predetermined intervals the grooved plate 64 is attached to the ejection element substrate 58 so that the heaters 59*ai*, are aligned one for one with the plurality of the grooves of the top plate 64, forming thereby a plurality of liquid paths 60*ai*, and a common liquid chamber 62 connected to each of the liquid paths 60*ai*.

The flat top surface of the holder 56 is provided with a plurality of recesses 56*a*, each of which is predetermined in position and depth, and to the bottom surface of each of which one ejection element substrate 58 is attached. Further, at the bottom surface of each recess 56*a*, there is the opening of one end of an ink supply path 62. The other end of the Ink supply path 62 leads into the corresponding ink container. The ejection element substrate 58 has a liquid path 58*b*, which coincides in location with the end of the ink supply path 62.

Figure 2:
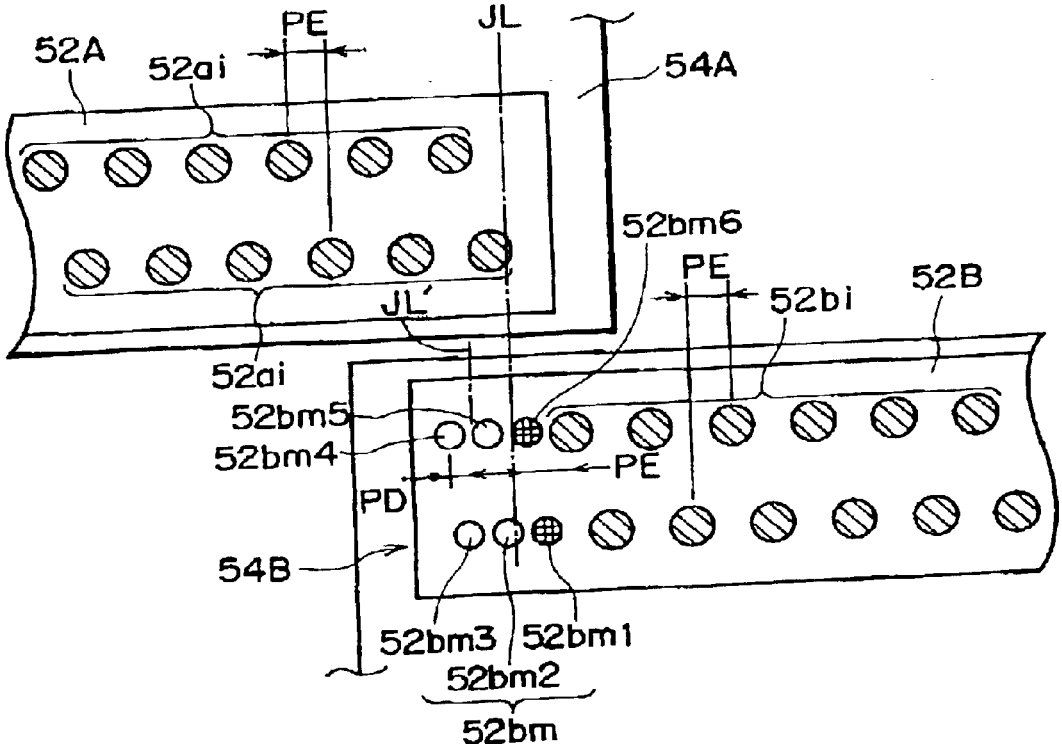
FIG. 2 is an enlarged plan view of the essential portion of the first embodiment of a recording head in accordance with the present invention.
Figure 6:
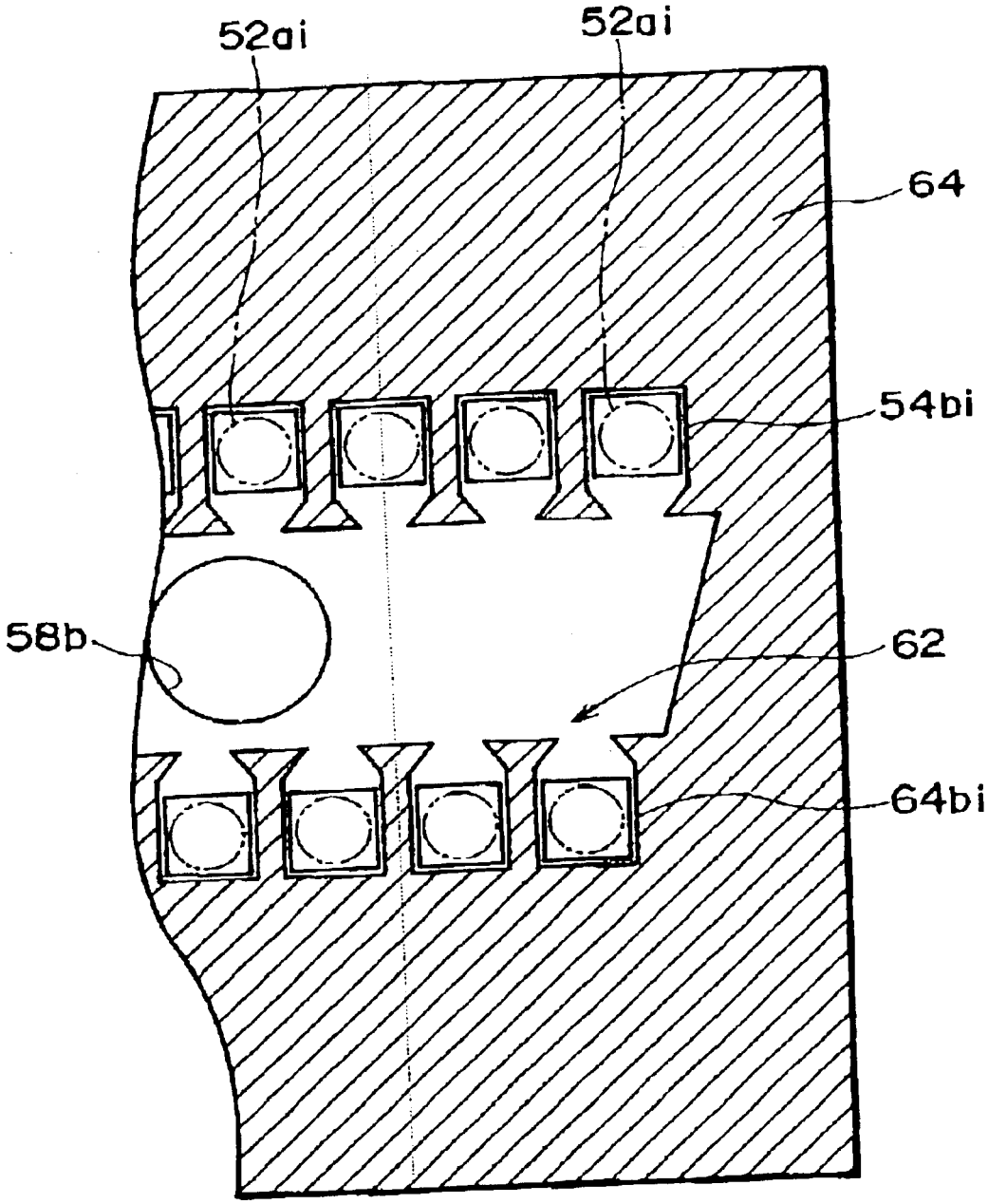
FIG. 6 is a sectional view of a part of the portion of the head chip in FIG. 5.

Referring to FIG. 6, the grooved plate 64, which is attached to the top surface of the ejection element substrate 58, is provided with the common ink chamber 62, which is on the inward side of the grooved plate 64. The common ink chamber 62 is connected to all of the ink paths 64*bi*, in which the plurality of heaters 58*ai* are disposed one for one. Referring to FIGS. 2 and 5, the grooved plate 64 is also provided with a plurality of ejection orifices 52*ai* (i=1–n, n being integer), which correspond one for one with the plurality of heaters 58*ai*, being disposed in the zigzag fashion, with the provision of a predetermined pitch.

The holder 56 is provided with plural wiring substrates 54A, each of which is disposed in a manner to surround the corresponding grooved plate 64. Each of wiring substrate 54A is formed with the use of ILB (Inner Lead Bonding), or the like method, being in electrical connection with the terminal of the corresponding heater 58*ai*, through the terminal of its lead. In other words, the grooved plate 64 is placed in the opening 54*h* of the corresponding wiring substrate 54A. The junction between the terminal of each heater and the terminal 54*a* of the lead wire 54*a* of the corresponding wiring substrate 54A is covered with a body of sealing resin 68 coated in a manner to cover the edge of the wiring substrate 54A and the edge of the grooved plate 64, as well as the junction. Thus, plural bodies of sealing resin 68 are aligned in the same direction as the direction in which the head chips 52A are aligned. Further, there is a gap SP between the edge of the head chip 52A, perpendicular to the head chip alignment direction, and the edge of the opening 54*h*, perpendicular to the head chip alignment direction.

On the other hand, each head chip 52B is, provided with a plurality of compensatory ejection orifices 52*bm*, which are aligned at one, both ends, of one, or both lines, of the ejection orifices 52*bi*, in a manner to extend the line, or lines, of the ejection orifices 52*bi*, as shown in FIG. 2. For example, there are three compensatory ejection orifices 52*bm* per line of the ejection orifices 52B, or the normal ejection orifices. In other words, there are compensatory ejection orifices 52*bm*1, 52*bm*2, 52*bm* 3, 52*bm*4, 52*bm*5, and 52*bm*6, which are arranged in the zigzag fashion, with the provision of predetermined intervals. The compensatory ejection orifices 52*bm*1, 52*bm*2, and 52*bm*3 are aligned in a manner to extend one of the lines of the normal ejection orifices 52*bi*, and the compensatory ejection orifices 52*bm*4, 52*bm* 5, and 52*bm* 6 are arranged in a manner to extend the other line of the normal ejection orifices 52B. In terms of the ejection orifice alignment direction, the distance PD between the compensatory ejection orifices 52*bm*3 and 52*bm*4 is set to be approximately half the distance PE between the two adjacent normal ejection orifices 52*bi* in the same line. The compensatory ejection orifices 52*bm*1–52*bm*6 are made smaller in diameter than the normal ejection orifices 52*bi*, in proportion to the distance PD.

Further, the ejection element substrate 58 is provided with additional heaters 58*ai*, which are disposed in a manner to correspond in position to the compensatory ejection orifices 52*bm*1–52*bm*6, and the groove plate 56 is provided with additional ink paths 64*bi*, which correspond in position to the compensatory ejection orifices 52*bm*1–52*bm*6, being arranged at a predetermined pitch.

The distance PE between two adjacent ejection orifices of the head chip 52A is the same as that of tile head chip 52B.

In terms of structure, the head chip 25B is different from the head chip 52A only in the portion of the grooved plate 64 corresponding to the compensatory ejection orifices 52*bm* and the portion of the ejection orifice substrate 58 corresponding to the compensatory ejection orifices 52*bm*. In other words, except for the portion other than the portion of the grooved plate 64 corresponding to the compensatory ejection orifices 52*bm* and the portion of the ejection element substrate corresponding to the compensatory ejection orifices 52*bm*, the head chip 52B is the same in structure as the head chip 52A.

Figure 3:
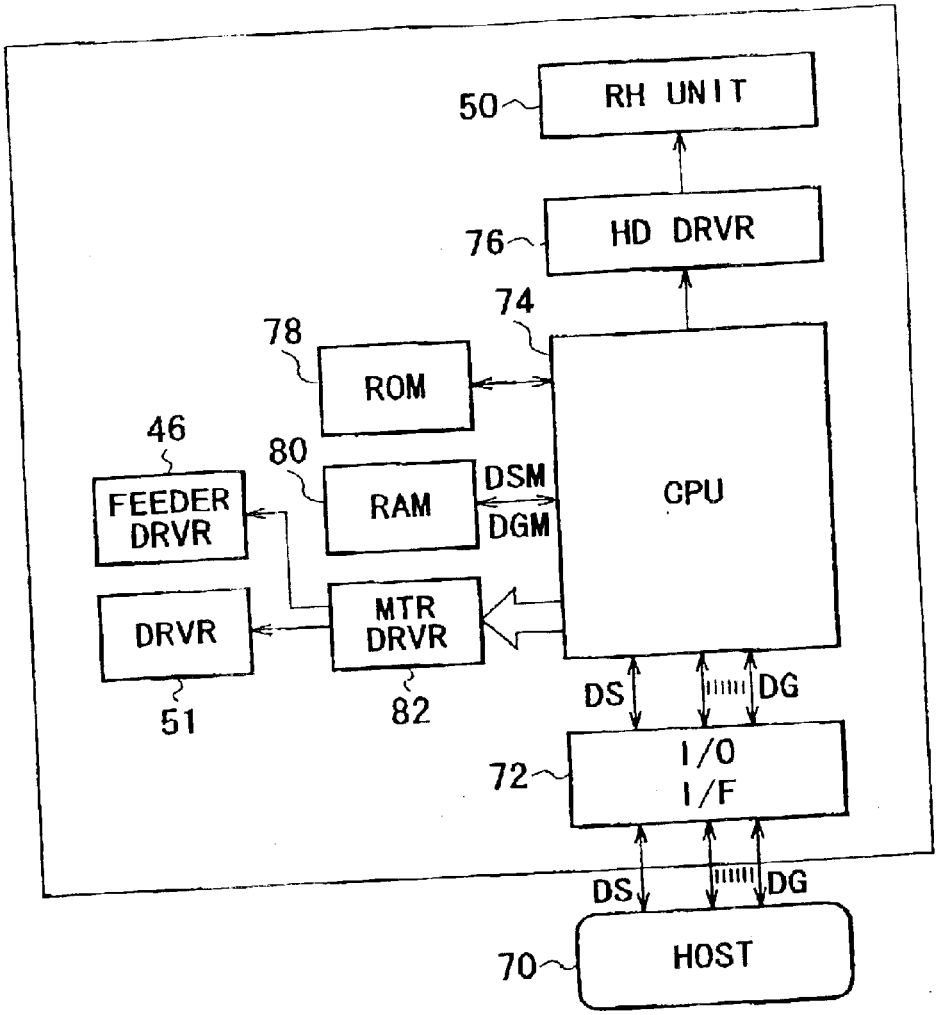
FIG. 3 is a block diagram for showing the control section of the recording head in FIG. 2.

Referring to FIG. 3, an example of a recording apparatus in accordance with the present invention has a control section.

The control section essentially comprises: a central processing unit (which hereinafter will be referred to as CPU) 74, which will be described later; an input/output interface 72; a read-only memory (which hereinafter will be referred to as ROM) 78; and a random access memory (which hereinafter will be referred to as RAM) 80. The CPU 74 controls the recording operation of the recording head unit 60, the operation of the carriage 40, and the operation of the driving portion 46. The input/output interface 72 inputs into the CPU 74, the recording operation data DG made up of the image formation data from a host computer 70 and the control data, and the compensatory operation data DS, which will be described later, and outputs to the host computer 70, the data from the CPU 74, which shows the state of the recording operation. The ROM 78 stores the control programs, and the RAM 80 stores the image formation data from the host computer 70, control data, compensatory operation data DS, address data for each of the compensatory ejection orifices of the recording head unit 50, and the like data.

The compensatory data DS are created by the host computer 70 based on the deviation in the positional relationship between a given head chip 52A and the head chip 52B adjacent to the given head chip 52A. More specifically, the actual distance between the given head chip 52A and the head chip 52B adjacent thereto is measured with the use of a microscope or the like. Referring to FIG. 2, when the extension of a referential line JL tangential to the endmost ejection orifice of the head chip 52A is tangential to the compensatory ejection orifice 52*bm*6 of the head chip 52B, the compensatory data DS are created so that the compensatory ejection orifices 52*bm*1 and 52*bm*6, in addition to the normal ejection orifices 52*bi*, are used during image forming operation, in order to ensure that a gap greater than a predetermined value is not created between the rightmost ejection orifice of the head chip 52A and the leftmost ejection orifice of the head chip 52B in terms of the ejection orifice alignment direction. On the other hand, if the extension JL, represented by the two-dot chain line, of the referential line JL is tangential to the compensatory ejection orifice 52*bm*5, the compensatory data DS are created so that the compensatory ejection orifices 52*bm*1, 52*bm*2, 52*bm*5, and 52*bm*6 are used.

The number of the compensatory ejection orifices to be enabled to be activated may be increased or decreased based on the quality of the images created by the actual recording operations involving the head chips 52A and head chips 52B. This also applies to the following embodiments.

Thus, the compensatory data DS, inclusive of the identities of the compensatory ejection orifices enabled to the activated based on the results of the above described observations, are inputted into the host computer 70, and then, are sent to the input/output interface 72 through the bidirectional transmission path.

The CPU 74 creates the control data for making the carriage 40 shuttle a predetermined distance based on the recording operation data DGM, and also, for intermittently conveying the recording paper Pa in synchronism with the recording operation. Then, it supplies the control data to the motor driver 82.

The motor driver 82 creates drive control signals based on the data from the CPU 74, and supplies the driving control signals to the driving motor 51 and conveyance roller unit driving portion 46.

Further, the CPU 74 carries out a predetermined image conversion process, based on the recording operation data DGM read from the RAM 80, creating a set of data corresponding to the head chips 52A and head chips 52B of the recording head unit 50, and supplies these data correspondent to the head chips 52A and head chips 52B, to the head driver 76.

While carrying out the predetermined image conversion process, the CPU 74 also uses the compensatory data DSM read from the RAM 80, and the image formation data, to create a set of data for making the chosen compensatory ejection orifices carry out recording operations, and supplies the created data to the head driver 76. Based on these sets of data supplied from the CPU 74, the head driver 76 creates a plurality of sets of drive control pulse signals, and supplies them to the recording head unit 50.

Figure 8:
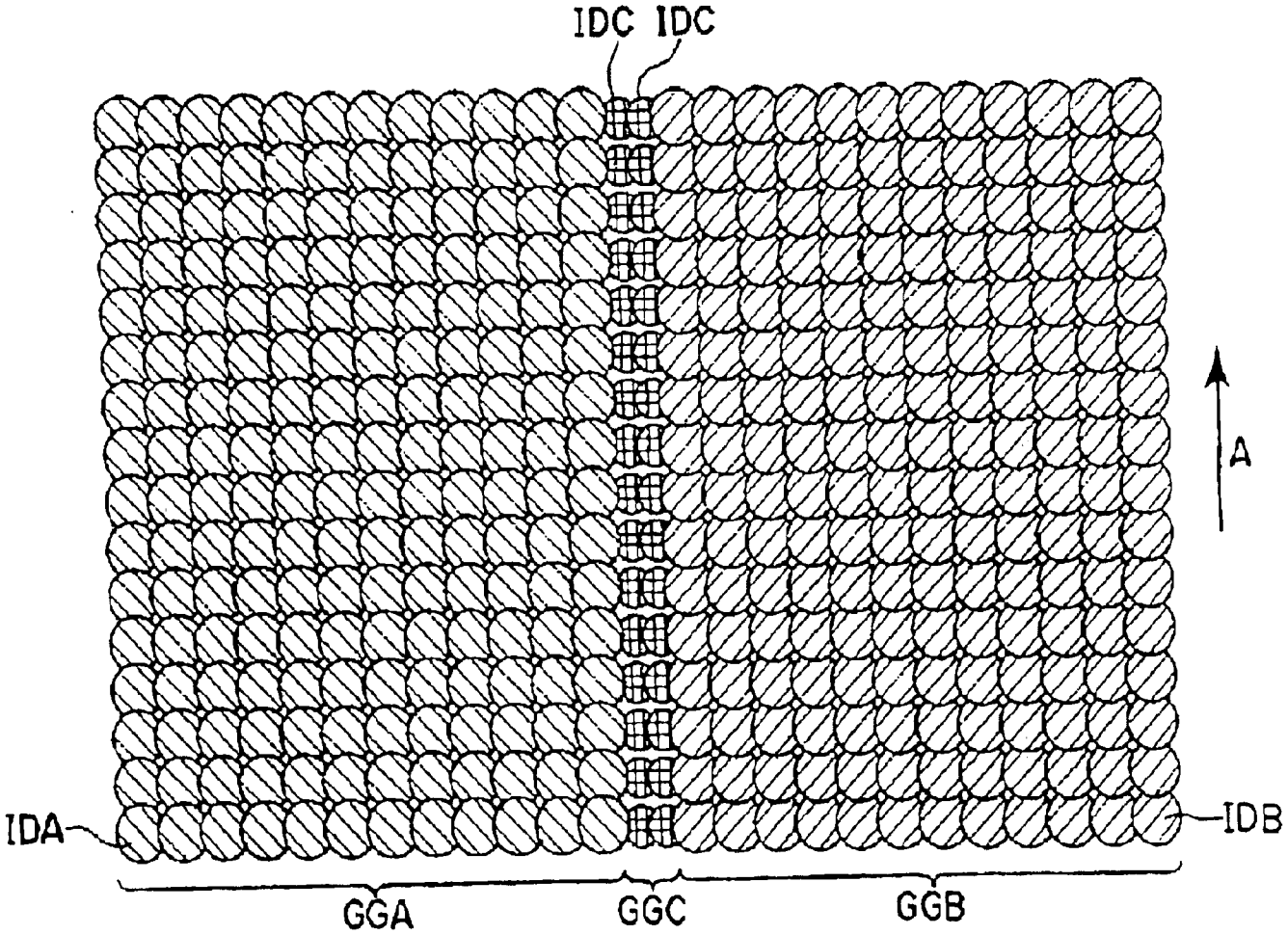
FIG. 8 is a drawing for describing the operation of the recording apparatus in FIG. 1.

Thus, as the recording head unit 50 is driven with the controlled timing, an image is formed on the recording surface of the recording paper Pa as shown in FIG. 8, for example.

FIG. 8 represents a part of the image region formed by a single head chip 52A as the head chip 52A was moved in the arrow A direction, add a part of the image region formed by a single head chip 52B as the head chip 52B was moved also in the arrow A direction.

The region GGA is made up of a set of dots IDA formed by the ink droplets ejected from the ejection orifices 52*ai* of the head chip 52A as they adhered to the recording surface of the recording paper Pa, and the region GGB is made up of a set of dots IDB formed by the ink droplets ejected from the ejection orifices 52*bi* of the head chip 52B as they adhered to the recording surface of the recording paper Pa. The region GGC is made up of a set of dots IDC formed by the ink droplets ejected from the compensatory ejection orifices 52*bm*6 and 52*bm*1 of the head chip 52B. The dot IDA, dot IDB, and dot IDC each is a picture element formed by a single ejection.

Therefore, it is possible to obtain an image which does not have the so-called white or black streak traceable to the deviation of the positional relationship between the head chip 52A and head chip 52B, across the area correspondent to the interval between the head chip 52A and head chip 52B, in terms of the head chip alignment direction, or across the area corresponding to the portions of the recording head unit where the head chip 52A and head chip 52B partially overlap with each other, in terms of the direction perpendicular to the head chip alignment direction.

However, in the case of this embodiment, the compensatory ejection orifices 52*mb* are made greater in dot density, and therefor, are made smaller in ink droplet volume, compared to the normal ejection orifices 52*bi*. The volume by which ink is ejected by each compensatory ejection orifice 52*mb* may be the same as the volume by which ink is ejected by each normal ejection orifice 52*bi*. It is obvious, however, that when each compensatory ejection orifice is smaller in ink ejection volume, by an amount proportional to recording density, than each normal ejection orifice, the amount of the image defects traceable to the deviation of the positional relationship between the head chip 52A and head chip 52B will be smaller than otherwise.

This embodiment of a recording head in accordance with the present invention is an example of a recording head having a plurality of head chips which are arranged in two straight lines so that the head chips in one line are offset relative to the head chips in the other lines; in other words, they are arrange in the zigzag fashion. It is characterized in that one end, or both ends, of each head chip, in terms of the alignment direction, in one line is provided with a plurality of compensatory ejection orifices which are aligned in such a manner that they extend the line formed by its normal ejection orifices, and also that the portion of the head chip, which has the compensatory ejection orifices, overlaps with the portion of the corresponding head chip in the other line, which has the last (or first normal ejection orifice. According to another characteristic aspect of this embodiment, the compensatory ejection orifices are disposed in a manner to increase the recording density of the recording head across the portion corresponding to the border portion between two adjacent head chips in terms of the head chip alignment direction. Thus, the size and intensity of the streaks formed by a recording head unit can be reduced by selecting, in number and configuration, the compensatory ejection orifices, according to the accuracy in the positional relationship between a given head chip in one line of the head chips and the corresponding head chip in the other line.

(Embodiment 2)

Figure 9:
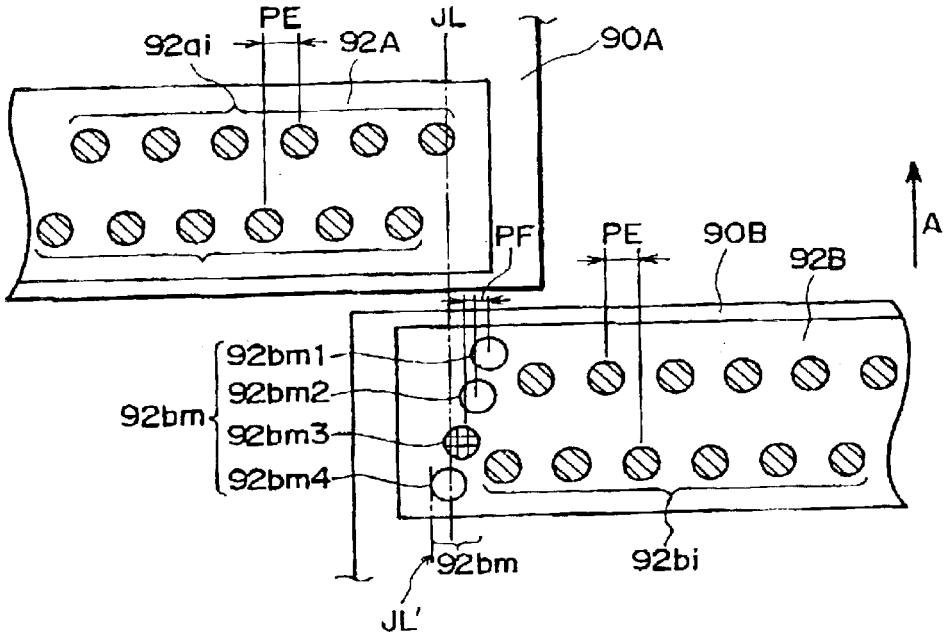
FIG. 9 Is a plan view of the essential portion of the second embodiment of a recording head in accordance with the present invention.

FIG. 9 shows the essential portion of the second embodiment of a recording head in accordance with the present invention.

Also in the case of the embodiment shown in FIG. 9, a set of head chips 92A and a set of head chips 92B are arranged in a manner similar to the above described first embodiment. That is, a plurality of head chips 92A are arranged in a manner to form a straight line roughly perpendicular to the moving direction of the carriage 40, that is, the direction indicated by an arrow mark A, along one edge of one of the flat surfaces of a holder, whereas a plurality of head chips 92B are arranged in a manner to form a straight line roughly parallel to the line formed by the plurality of head chips 92A, along the other edge of the same flat surface of the holder. Further, the set of head chips 92A and set of head chips 92B are attached, along with the set of wiring substrates 90A and set of wiring substrate 90B electrically connected thereto, one for one, to the flat surface of the supporting member in the zigzag fashion, with the provision of a predetermined interval, between two adjacent head chips. Further, the two sets of head chips 92A and 92B are positioned with the use of a predetermined jig, with a positional tolerance of approximately ±0.1 mm Each head chip 92A has the same internal structure as the head chip 52A in the above described embodiment. It has a plurality of ejection orifices 92*ai* (i=n, n being integer), which are open at the ejection surface of the head chip 92A, being arranged in two roughly parallel two straight lines, with the provision of a predetermined interval PE in the line direction. In terms of the arrow A direction, the ejection orifices in one line are offset from the corresponding ejection orifices in the other line: in other words, the ejection orifices 92*ai* of the head chip 92A are arranged in the zigzag fashion.

Except for one, or both, of the lengthwise end portions, each head chip 92B is the same in structure as each head chip 92A. That is, it has a plurality of ejection orifices 92*bi* (i=n, n being integer), which are open at the ejection surface of the head chip 92B, being arranged in two roughly parallel straight lines, with the provision of a predetermined interval PE in the line direction. In terms of the arrow A direction, the ejection orifices in one line are offset from the corresponding ejection orifices in the other line; in other words, the ejection orifices 92*bi* of the head chip 92B are arranged in the zigzag fashion. However, one, or both, of the lengthwise ends of each head chip 92A are provided with a plurality of compensatory ejection orifices 92*bm* aligned in a predetermined direction. These compensatory ejection orifices, for example, 92*bm*1, 92*bm*2, 92*bm*3, and 92*bm*4 are positioned across the portion of each head chip 92B, which corresponds to the portion of the corresponding head chip 92A, across which the first and second ejection orifices, counting from the lengthwise end of the head chip 92A, are positioned.

More specifically, the compensatory ejection orifices 92*bm*1, 92*bm*2, 92*bm*3, and 92*bm*4 are aligned roughly in parallel to the line connecting the centers of the first and second normal ejection orifices 92*bi*, counting from the lengthwise end of the head chip 92B; in other words, they are diagonally aligned. Referring to FIG. 9, in terms of the lengthwise direction of the head chips 92B, the distance PF between the two vertical lines which coincide, one for one, with the centers of the two adjacent compensatory ejection orifices among 92*bm*1–92*bm*4, is approximately half the distance PE between the two vertical lines which coincide, one for one, with the center of a given normal ejection orifice 92*ai* and the ejection orifice 92*bi* adjacent thereto. Further, in terms of diameter, the compensatory ejection orifices 92*bm*1–92*bm*4 are the same as the normal ejection orifice 92*ai* and normal ejection orifice 92*bi*.

Figure 10:
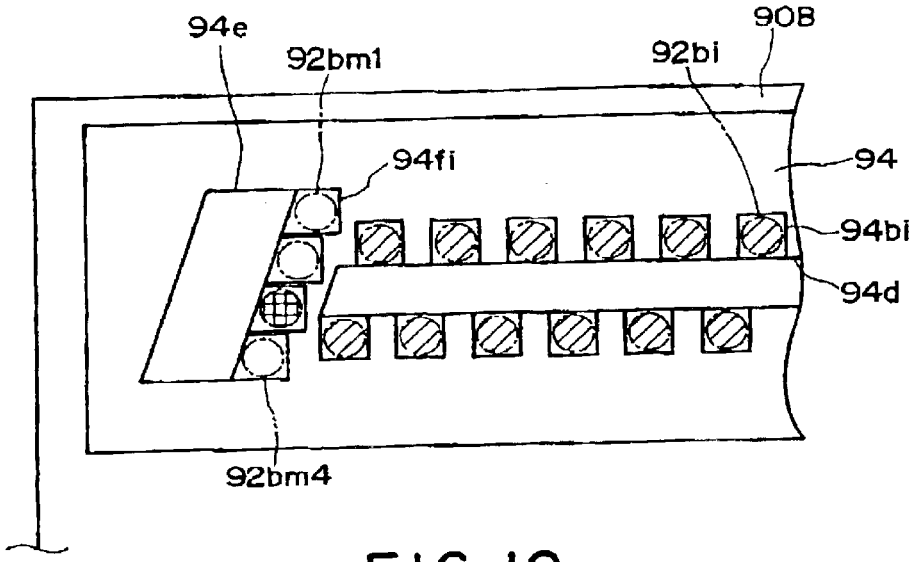
FIG. 10 is a sectional view of a part of the portion of the head chip in FIG. 9.

Referring to FIG. 10, the grooved plate 94 of each head chip 92B has a plurality of ink paths 94*bi* which correspond one for one to the plurality of ejection orifices 92*bi*. The grooved plate 94 of each head chip 92B also has a common ink supply path 94*d*, which runs through the center of the grooved plate 94, being connected to all of the ink paths 94*bi*. The common ink supply path 94*d* is closed at both ends. Further, the grooved plate 94 of each head chip 92B has a plurality of ink paths 94*fi* leading one for one to the aligned compensatory ejection orifices 92*bm*. Each ink path 94*fi* is connected to a common ink supply path 94*e*.

The FI ejection element substrate of each head chip 92B has a plurality of heaters corresponding one for one to the plurality of ink paths 94*bi* and plurality of ink paths 94*fi*.

When a recording operation is carried out by a recording head unit comprising the set of head chips 92A and set of head chips 92B structured as described above, the host computer 70 creates the compensatory data DS, based on the deviation in the positional relationship between a given head chip 92A and the head chip 92B adjacent thereto. More specifically, the actual distance between the given head chip 92A and the head chip 92B adjacent thereto is measured with the use of a microscope or the like. Referring to FIG. 9, when the extension of a referential line JL tangential to the endmost ejection orifice of the head chip 92A is also tangential to the compensatory ejection orifice 92*bm*3 of the head chip 92B, the compensatory data DS are created so that the compensatory ejection orifice 92*bm*3 are activated, in addition to the normal ejection orifices 92*bi*, in order to ensure that a gap greater than a predetermined value is not created between the rightmost ejection orifice of the head chip 92A and the leftmost ejection orifice of the head chip 92B, in terms of the ejection orifice alignment directions in FIG. 9. On the other hand, if the extension JL', represented by the two-dot chain line, of the referential line JL is tangential to the compensatory ejection orifice 92*bm*4, the compensatory data DL are created so that the compensatory ejection orifices 92*bm*3 and 92*bm*4 are activated.

The CPU 74 supplies to the head driver 76, the data obtained by carrying out the above described processes.

While carrying out the above described processes, the CPU 74 also uses the compensatory data DSM read from the Ram 80, and the image formation data, to create a set of data for making the chosen compensatory ejection orifices carry out recording operations, and supplies tile created data to the head driver 76.

Based on these sets of data supplied from the CPU 74, the head driver 76 creates a plurality of sets of drive control pulse signals, and supplies them to the recording head unit.

Figure 11:
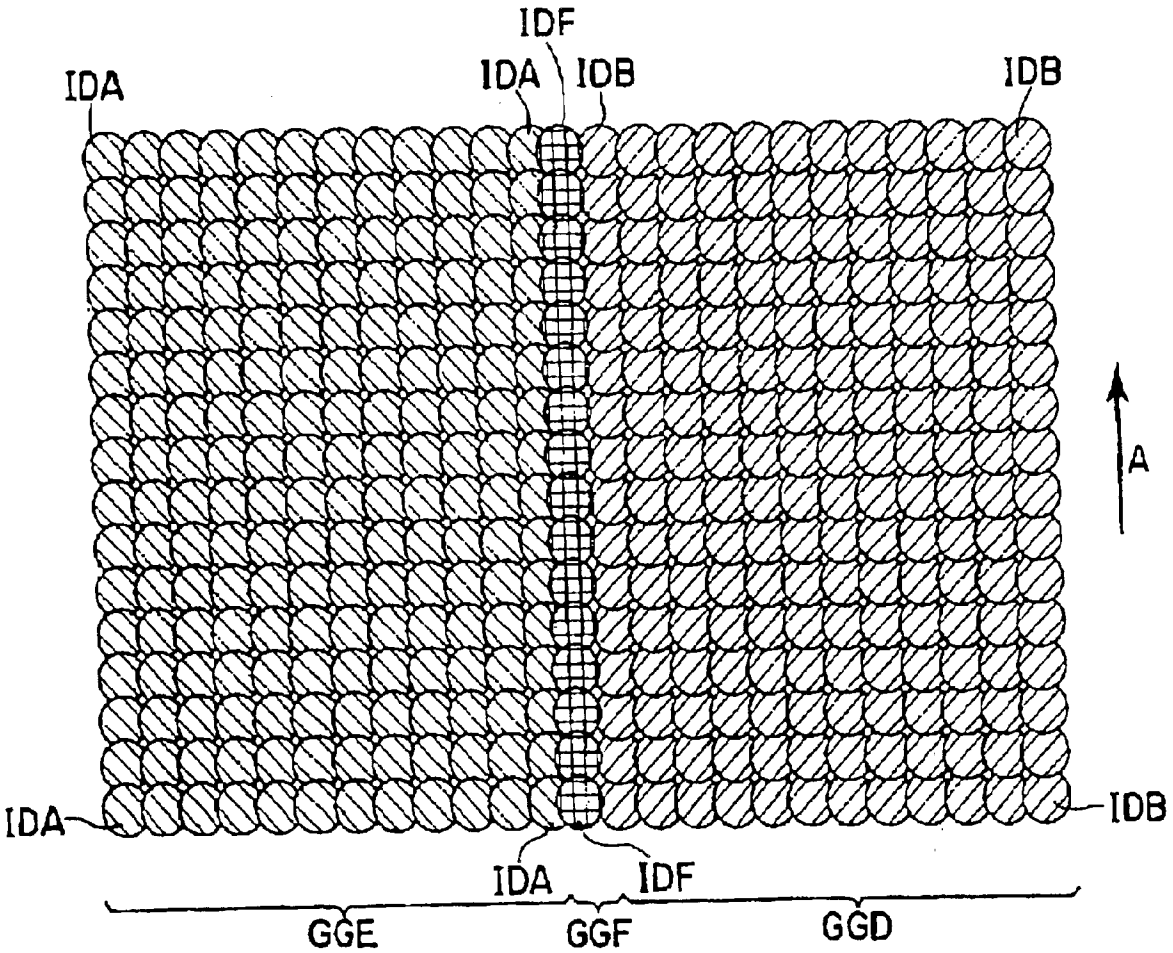
FIG. 11 is a drawing for describing the operation of the recording head in FIG. 9.

Thus, as the recording head unit is driven is with the controlled timing, an image is formed on the recording surface of the recording paper Pa as shown in FIG. 11, for example.

FIG. 11 represents a part of the image region formed by a single head chip 92A as the head chip 92A was moved in the arrow A direction, and a part of the image region formed by a single head chip 92B as the head chip 92B was moved also in the arrow A direction.

The region GGE is made up of a set of dots IDA formed as the ink droplets ejected from the head chip 92A adhered to the recording surface of the recording paper Pa, and the region GGD is made up of a set of dots IDB formed by the ink droplets ejected from the head chip 92B as they adhered to the recording surface of the recording paper Pa. The region GGF is made up of a set of dots IDF formed by the ink droplets ejected from the compensatory ejection orifices 92*bm*3 of the head chip 92B as they adhered to the recording surface of the recording paper Pa.

Therefore, it is possible to obtain an image which does not have the so-called white or black streak traceable to the deviation of the positional relationship between the head chip 92A and head chip 92B, across the area correspondent to the interval between the head chip 92A and head chip 92B, or the overlapping portions of the head chip 92A and head chip 92B, respectively.

Also in the case of this embodiment, the head design may be such that the compensatory ejection orifices 92*mb* are the same as or different from, the normal ejection orifices, in terms of ink droplet volume.

(Embodiment 3)

Figure 12:
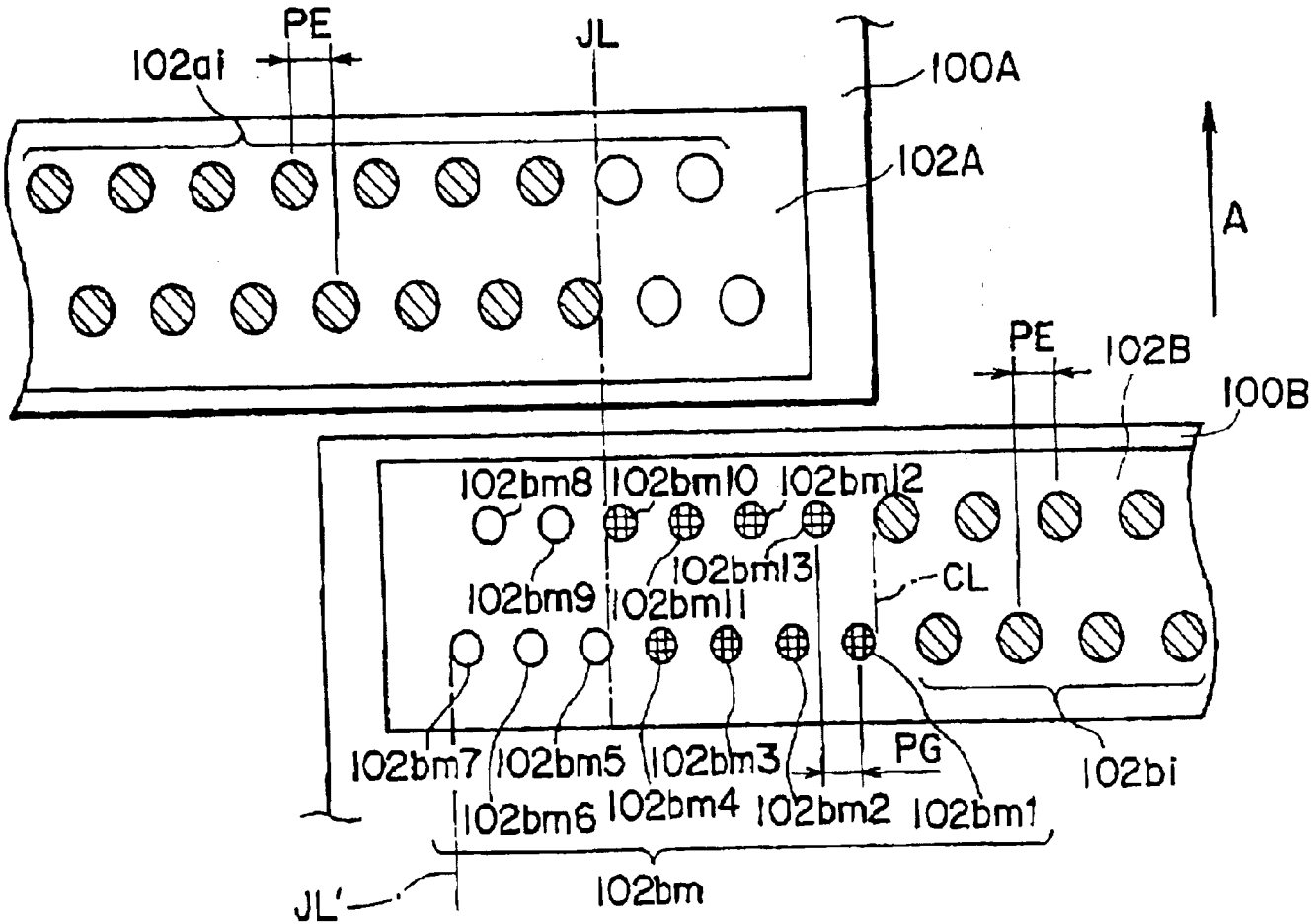
FIG. 12 is an enlarged plan view of the essential portion of the third embodiment of a recording head in accordance with the present invention.

FIG. 12 shows the essential portion of the third embodiment of a recording head in accordance with the present invention.

The embodiment in FIG. 12 is provided with a plurality of head chips 102A arranged in a manner to form a straight line roughly perpendicular to the moving direction of the carriage 40, that is, the direction indicated by an arrow mark A, with the provision of a predetermined interval between the two adjacent head chips, and a plurality of head chips 102B arranged in the same manner as the plurality of head chips 102A. The line formed by the head chips 102A and the line formed by the head chips 102B are roughly parallel to each other. Further, the set of head chips 102A and set of head chips 102B are attached, along with the set of wiring substrates 100A and set of wiring substrate 100B electrically connected thereto, one for one, to the flat surface of the supporting member in the zigzag fashion, with the provision of a predetermined interval between two adjacent head chips. The head chips 102A and head chips 102B are positioned with the use of a predetermined jig, with a tolerance of approximately ±0.1 mm.

Each head chip 102A has the same internal structure as the above described head chip 52A. It has a plurality of ejection orifices 102*ai* (i=n, n being integer), which are open at the ejection surface of the head chip 102A, being arranged in the zigzag fashion, with the provision of a predetermined interval PE between the two adjacent ejection orifices, in terms of the line direction. The internal structure of each head chip 102B is similar to that of each head chip 102A.

More specifically, except for one, or both, of the lengthwise end portions, each head chip 102B is the same in structure as each head chip 102A. That is, it has a plurality of ejection orifices 102*bi* (i=n, n being integer), which are open at the ejection surface of the head chip 102B, being arranged in the zigzag fashion, with the provision of a predetermined interval PE, in terms of the lengthwise direction of the head chip 102B. However, one, or both, of the lengthwise ends of each head chip 102B are provided with a plurality of compensatory ejection orifices 102*bm*.

More specifically, referring to FIG. 12, the plurality of compensatory ejection orifices 102*bm* are located so that, in terms of the moving direction of the carriage, the portion of the head chip 102B, across which the compensatory ejection orifices 102*bm*1 are located, overlaps with the portion of the head chip 102A, across which the first to eighth ejection orifices 102*ai*, counting from the right edge of the head chip 102A, are located. That is, the compensatory ejection orifices 102*bm* are arranged in a manner to form two extensions of the two straight lines, one for one, formed by the normal ejection orifices 102*bi* in the lengthwise direction of the head chip 102B; for example; the compensatory ejection orifices 102*bm*1, 102*bm*2, 102*bm*3, 102*bm*4, 102*bm*5, 102*bm*6, and 102*bm*7 form the above described one extension, and the compensatory ejection orifices 102*bm*8, 102*bm*9, 102*bm*10, 102*bm*11, 102*bm*12, and 102*bm*13 form the other extension. Further, in terms of the lengthwise direction of the head chip 102B, the compensatory ejection orifices 102*bm* in the above described one extension are offset from the corresponding compensatory ejection orifices 102*bm* in the other extension; in other words, in terms of the lengthwise direction of the head chip 102B, the compensatory ejection orifices 102*bm*1–102*bm*13 are arranged in the zigzag fashion. Also referring to FIG. 12, the compensatory ejection orifice 102*bm*1 is positioned so that the vertical line CL tangential to the right side of the compensatory ejection orifice 102*bm*1 is also tangential to the left side of the first normal ejection orifice 102*bi*, counting from the left end of the head chip 102B, positioned diagonally above the compensatory ejection orifice 102*bm*1 in the drawing.

The distance PG between the centers of the two numerically consecutive compensatory ejection orifices among 102*mb*1–102*mb*13, is set to a smaller value compared to the distance PE between the centers of the two numerically adjacent normal ejection orifices 102*bi*. Further, the compensatory ejection orifices 102*bm*1–102*bm*13 are made smaller in diameter than the normal ejection orifices 102*bi*.

The unshown groove plate of each head chip 102B has a plurality of ink paths which correspond one for one to the aligned compensatory ejection orifices 102*bm*1–102*bm*13. Further, the unshown ejection element substrate of each head chip 102B has a plurality of heaters corresponding one for one to the plurality of compensatory ejection orifices aligned compensatory ejection orifices 102*bm*1–102*bm*13.

When a recording operation is carried out by a recording head unit comprising the set of head chips 102A and set of head chips 102B structured as described above, the host computer 70 creates the compensatory data DS, based on the deviation in the positional relationship between a given head chip 102A and the head chip 102B adjacent thereto. More specifically, for example, when a referential line JL tangential to one of the normal ejection orifices 102*ai*. located on one of the lengthwise end portions of the head chip 102A is also tangential to the compensatory ejection orifices 102*bm*5 and 102*bm*10 of the head chip 102B, the compensatory data DS are created so that the compensatory ejection orifices 102*bm*1–102*bm*4, and 102*bm*10–102*bm*13, which are located between the normal ejection orifices of the head chip 102A, in contact with the referential line JL in FIG. 12, and the leftmost normal ejection orifice 102*bi* of the head chip 102B, in terms of the lengthwise direction of a head chip, are enabled to be used for compensation during a recording operation. In this case, the ejection orifices 102*ai* of the head chip 102A, on the left side of the referential line JL, are not used.

On the other hand, if the extension JL', of the referential line JL is tangential to the compensatory ejection orifice 102*bm*7, as represented by the two-dot chain line, the compensatory ejection orifices 102*bm*1–102*bm*13 are used in entirety.

The CPU 74 supplies to the head driver 76, the data obtained by carrying out the above described processes.

While carrying out the above described processes, the CPU 74 also uses the compensatory data DSM read from the RAM 80, and the image formation data, to create a set of data for making the chosen compensatory ejection orifices carry out recording operations, and supplies the created data to the head driver 76. Based on these sets of data supplied from the CPU 74, the head driver 76 creates a plurality of sets of drive control pulse signals, and supplies them to the recording head unit.

Figure 13:
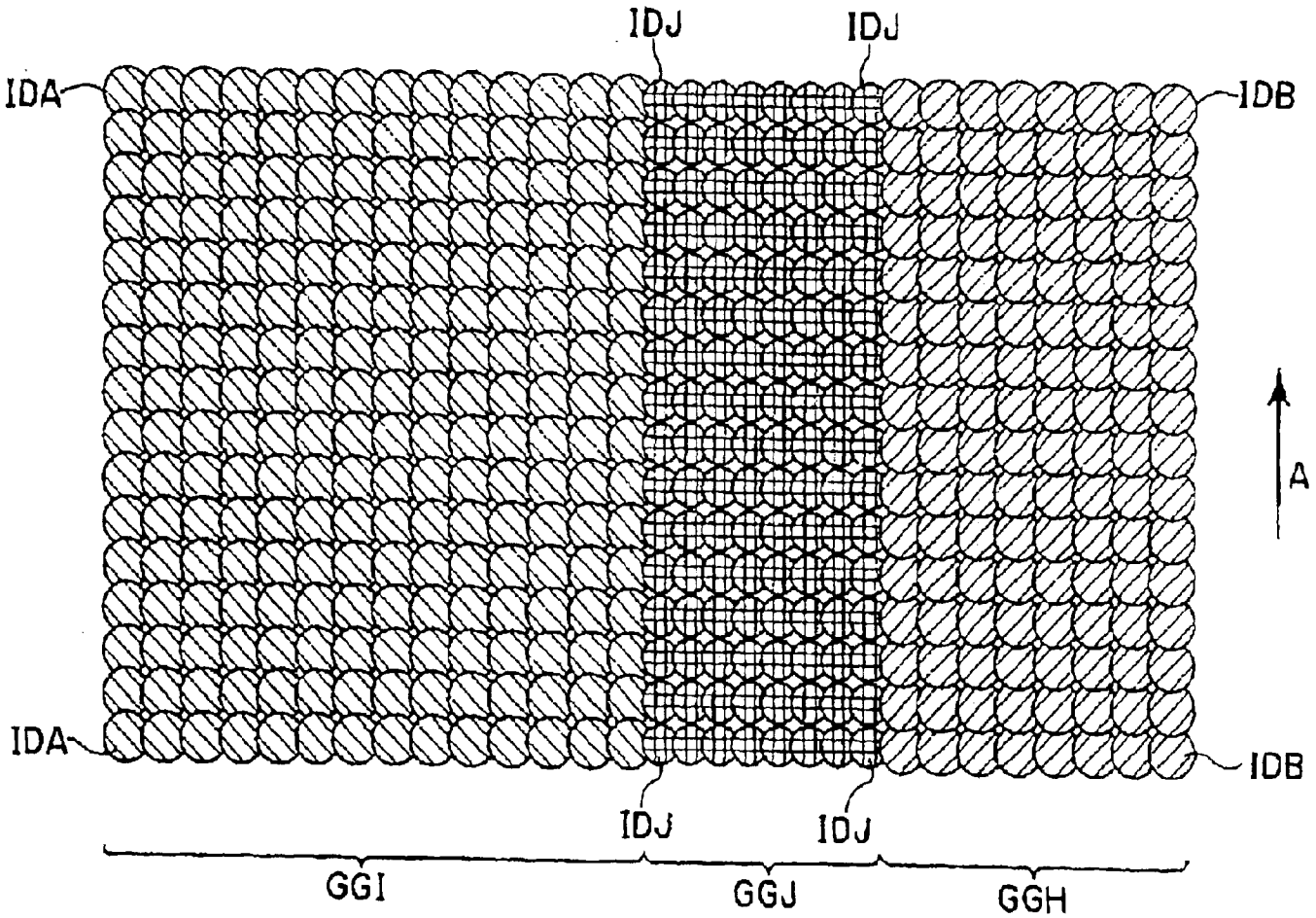
FIG. 13 is a drawing for describing the operation of the embodiment in FIG. 12.

Thus, as the recording head unit is driven with the controlled timing, an image is formed on the recording surface of the recording paper Pa as shown in FIG. 13, for example.

FIG. 13 represents a part of the image region formed by a single head chip 102A as the head chip 102A was moved in the arrow A direction, and a part of the image region formed by a single head chip 102B as the head chip 102B was moved also in the arrow A direction.

The region GGI is made up of a set of dots IDA formed by the ink droplets ejected from the head chip 102A as they adhered to the recording surface of the recording paper Pa, and the region GGH is made up of a set of dots IDB formed by the ink droplets ejected from the head chip 102B as they adhered to the recording surface of the recording paper Pa. The region GGJ is made up of a set of dots IDJ formed by the ink droplets ejected from the compensatory ejection orifices 102*bm*1–102*bm*4, and 102*bm*10–102*bm*13, of the head chip 102B as they adhered to the recording surface of the recording paper Pa.

Therefore, it is possible to obtain an image which does not have the so-called white or black streak traceable to the deviation of the positional relationship between the head chip 102A and head chip 102B, across the area correspondent to the range in which the head chip 102A and head chip 102B partially overlap with each other in terms of the moving direction of the carriage, that is, the arrow A direction.

Also in the case of this embodiment, the head design may be such that the compensatory ejection orifices 102*mb* are the same as, or different from, the normal ejection orifices, in terms of ink droplet volume.

(Embodiment 4)

Figure 14:
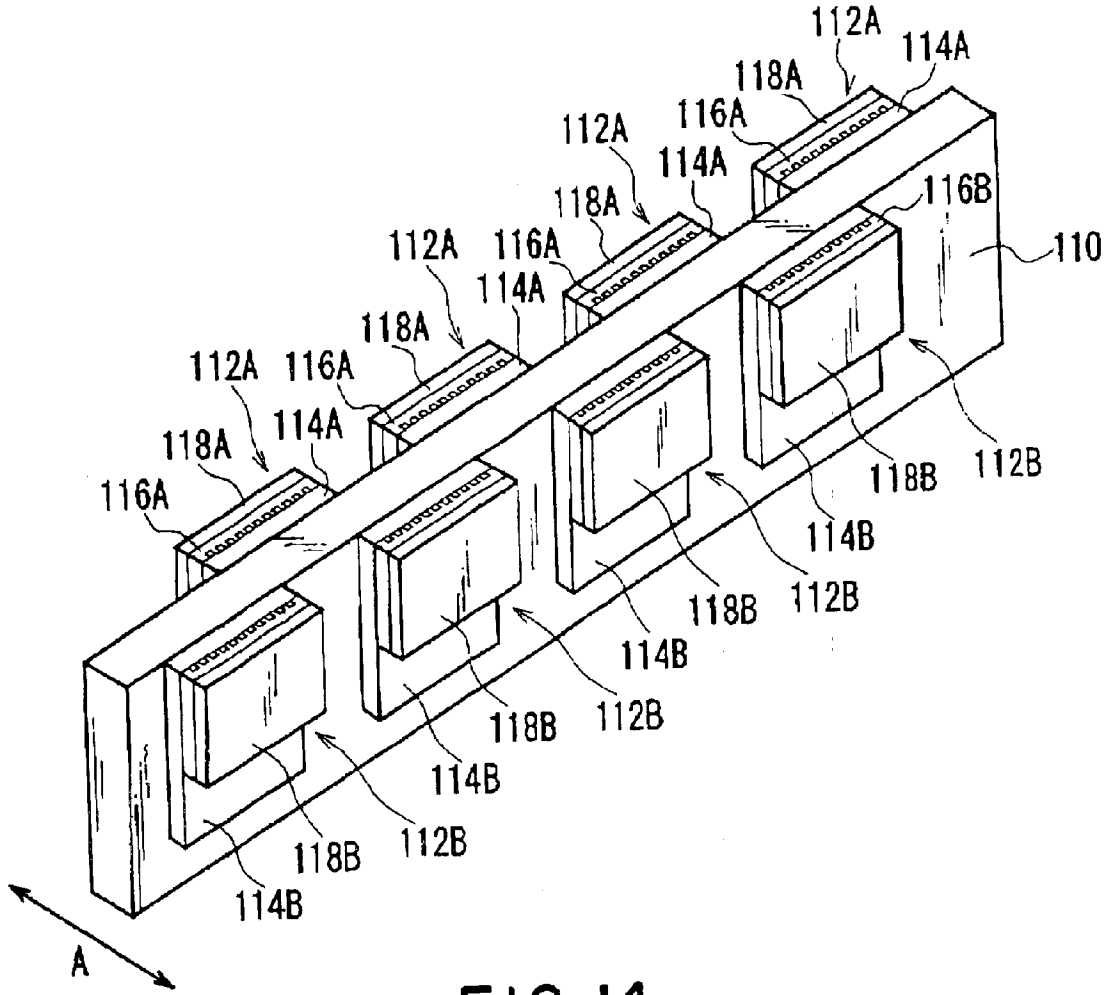
FIG. 14 is a perspective view of the fourth embodiment of a recording head in accordance width the present invention.

FIG. 14 shows the essential portion of the third embodiment of a recording head in accordance with the present invention.

The embodiment in FIG. 14 has a supporting plate 110, a set of head chips 112A arrange on one of the two largest vertical flat surfaces of the supporting plate 110, and a set of head chips 112B arranged on the other of the two largest vertical flat surface of the supporting plate 110. Each of the head chips 112A and 112B has a plurality of ink ejection orifices The head chips 112A are arranged in a straight line roughly perpendicular to the moving direction of the carriage 40, that is, the direction indicated by an arrow mark A, with the provision of a predetermined interval between adjacent two head chips 112A, and so are the head chips 112A, with the provision of the predetermined interval between the adjacent two head chips 112B. Thus, the lines which the set of head chips 112A form and the which the set of head chips 112B form are roughly parallel to each other. In terms of the ordinal number, inclusive of both sets of the head chips, determined based on the distance from one of the lengthwise ends of the supporting plate 110, the head chips are arranged in the zigzag fashion, with the provision of a predetermined interval between a given head chip 112A and the head chip 112B adjacent thereto. Further, the two sets of head chips 112A and 112B are positioned with the use of a predetermined jig, with a tolerance of approximately ±0.1 mm, for example.

Figure 15:
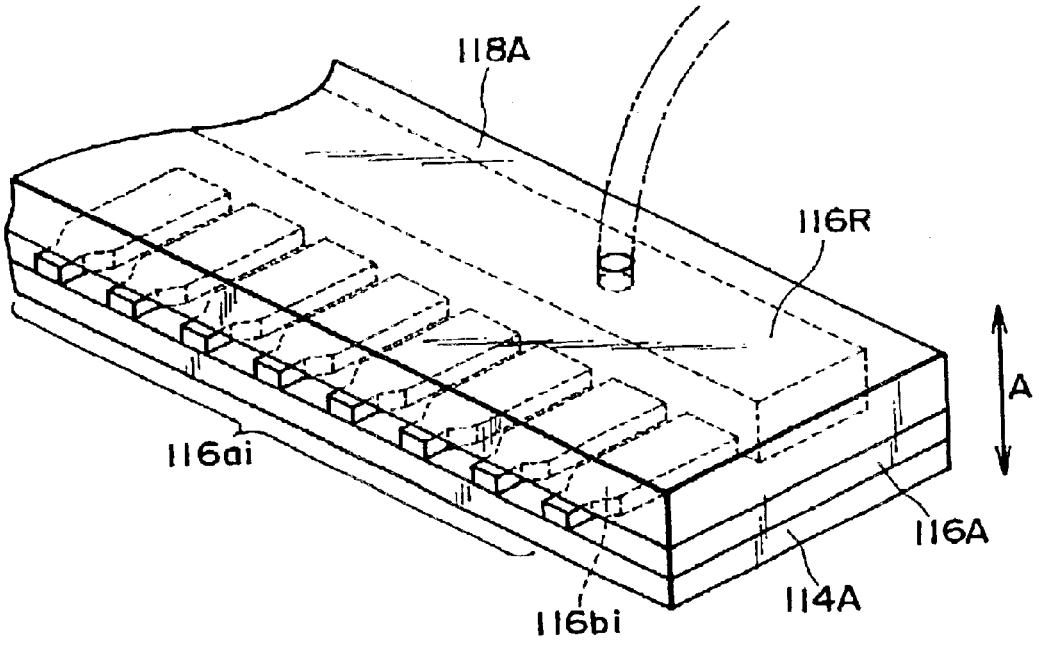
FIG. 15 is a perspective view of one of the head chips shown in FIG. 14, for showing the structure thereof.
Figure 17:
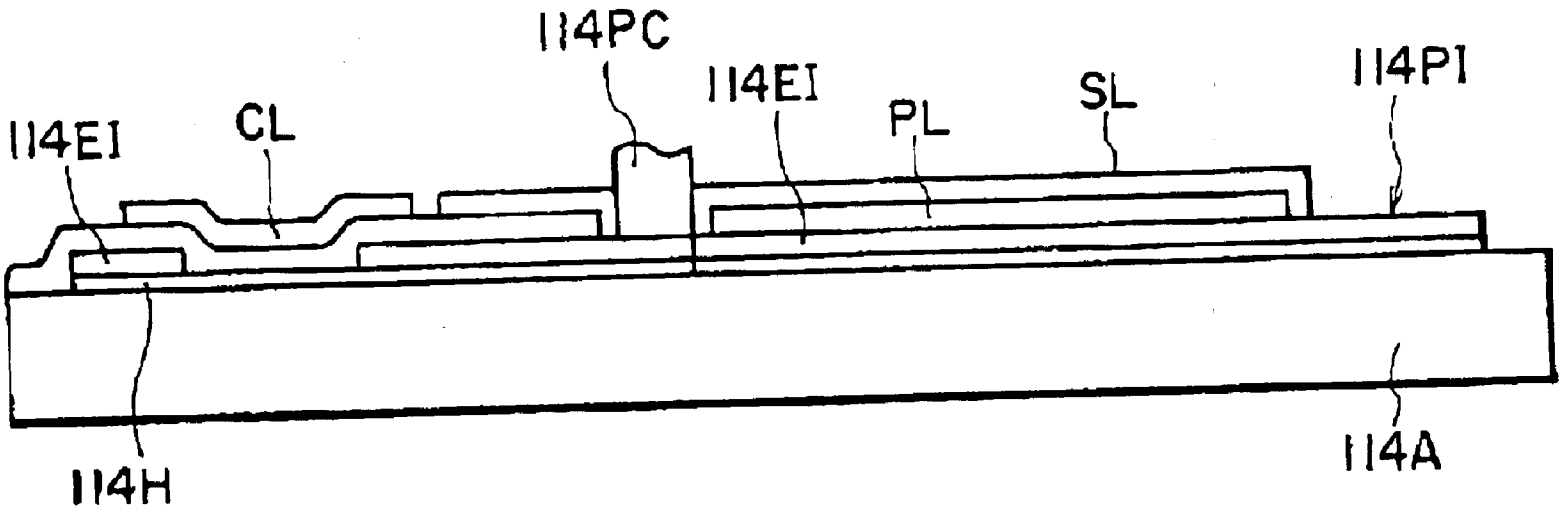
FIG. 17 is a sectional view of a part of the head chip in FIG. 16, at the plane XVII—XVII in FIG. 16.

Referring to FIGS. 15 and 17, each head chip 112A comprises an ejection element substrate 114A, a liquid path formation member 116A, and a top plate 118A. The ejection element substrate 114A has a plurality of electrothermal transducers, which will be described later, and is attached to one of the aforementioned two larger vertical flat surfaces of the supporting plate 110. The liquid path formation member 116A forms, in cooperation with the top plate 118A, a plurality of ink paths leading, one for one, to the plurality of the ejection orifices of the recording element substrate 114A, and a common liquid chamber 116R. The top plate 118A is attached to the top surface of the liquid path formation member 116A to cover the liquid path formation member 116A.

Figure 16:
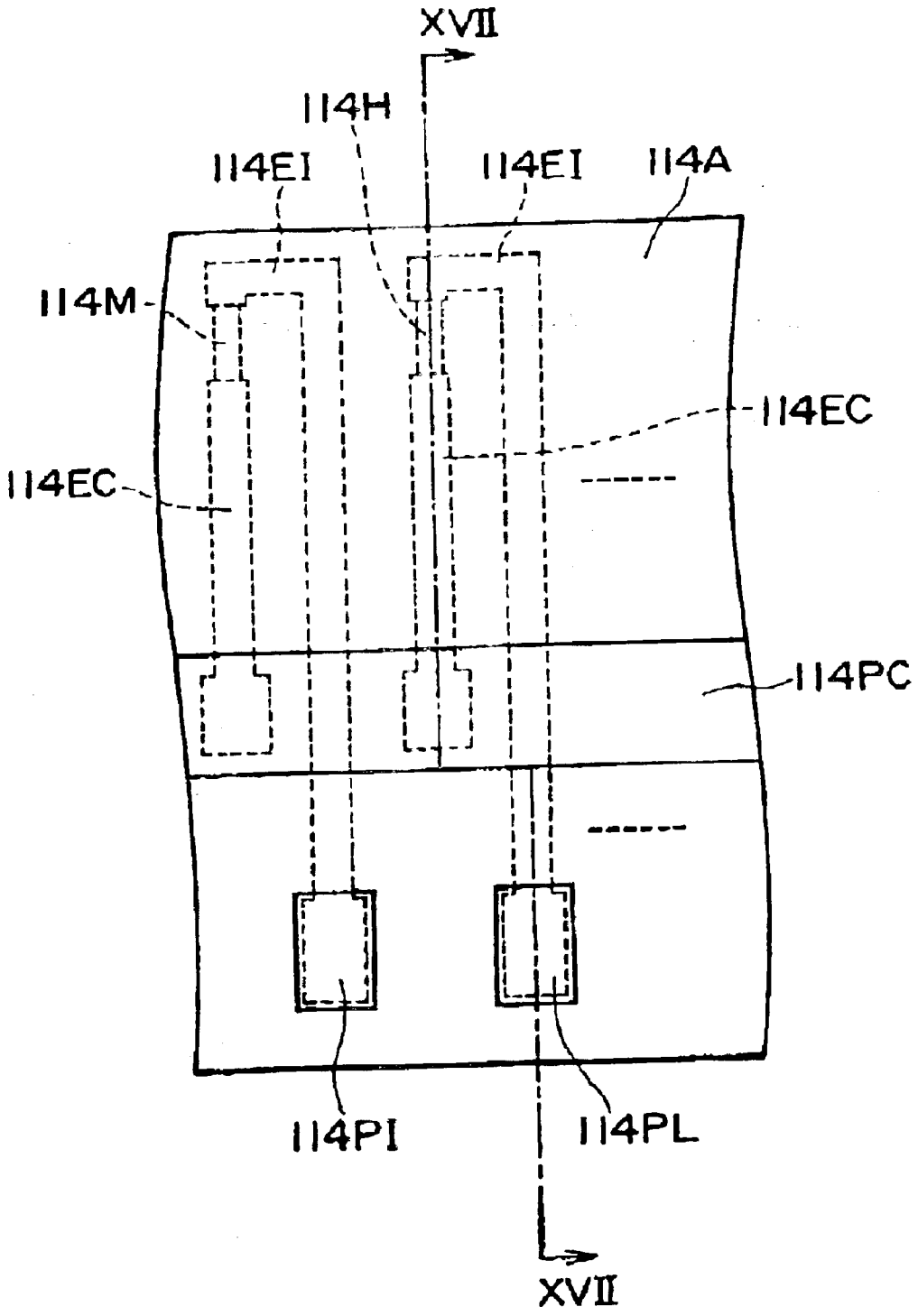
FIG. 16 is a plan view of a part of one of the head chips in FIG. 14, for showing the structure of the recording element substrate of the head chip.

The recording element substrate 114A is formed of a plate of silicon (Si), glass, ceramic, aluminum, aluminum alloy, or the like. Referring to FIG. 16, on the surface of the recording element substrate 114A, there are a heater layers 114H, as electrothermal transducers, which correspond in position to the plurality of ink paths, one for one, wiring layers 114EI connected to the plurality of the heater layers 114H, one for one, and a wiring layers 114EC comprising the common electrode. The healer layers and wiring layers are formed in the form of film, in predetermined patterns, with the use of photolithographic technologies. The heater layers, etc., on the recording element substrate 114A are in electrical connection with the control section, through a common electrode pad 114PC, and an individual electrode pad 114PI. The control section sends out drive control signals to the heater layers. Referring to FIG. 17, each healer layer 114H is covered with a protective layer PL and an anti-cavitation layer CL, whereas each individual wiring layer 114EI and each common electrode layer 114EC are covered with a protective layer PL and an insulating layer SL.

The liquid path formation member 116A and top plate 118A placed in layers on the recording element substrate 114A are made with the use of a photolithographic means, the method for airtightly adhering a molded top plate having nozzles, onto the recording element substrate 114A, or the like.

Referring to FIG. 15, the liquid path formation member 116A has a plurality of ejection orifices 116*ai* (i=1–n, n being integer), which are in connection to the ink-paths 116*bi* (i=n, n being integer), one for one, and which are aligned in the direction roughly perpendicular to the moving direction of the recording bead unit indicated by an arrow mark A. The top plate 118A is in connection to one end of the unshown ink supply path. With the provision of the above described setup, the ink within an ink container is supplied to the common liquid chamber 116R through the ink supply path.

Figure 18:
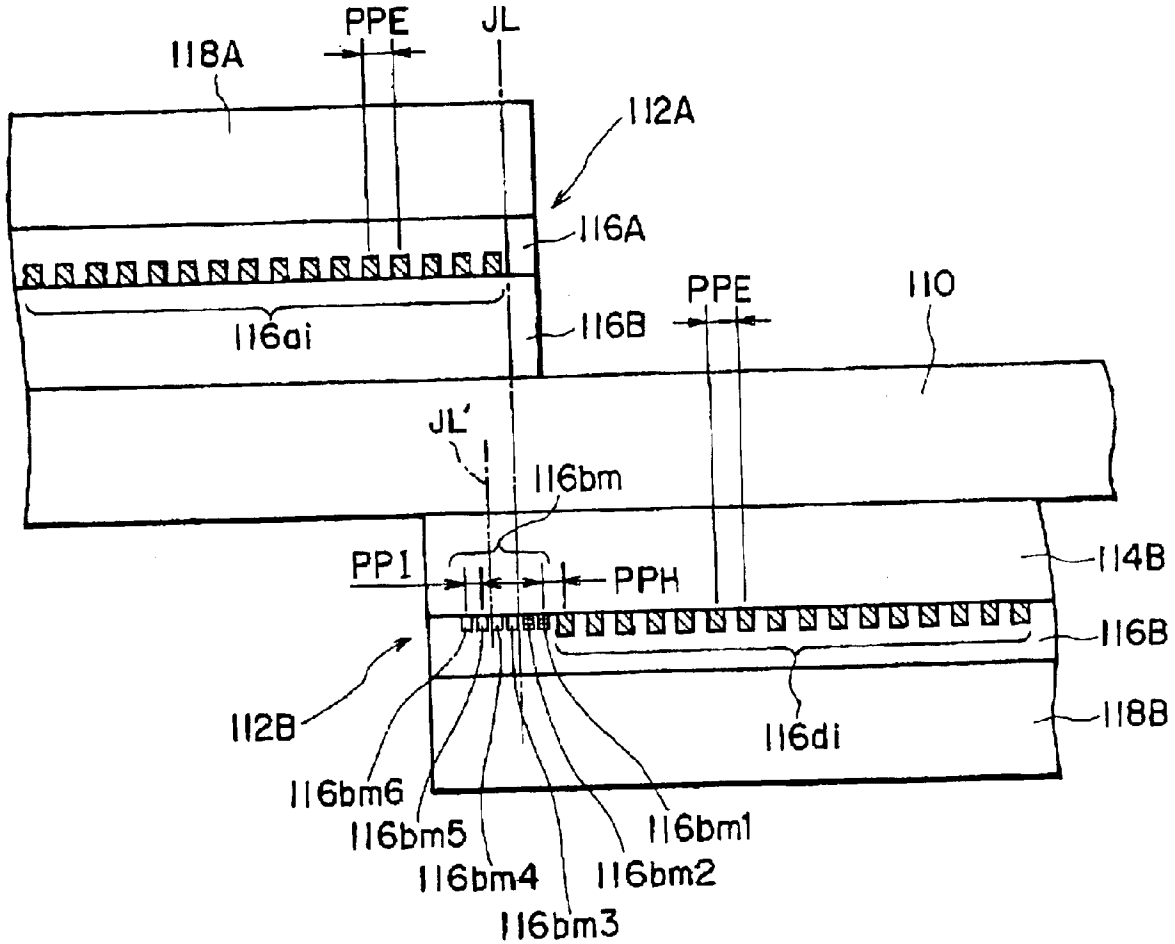
FIG. 18 is a plan view of the essential portion of the head chip shown in FIG. 14, as seen from the outward side of the ejection orifices.

Referring to FIG. 18, on the other hand, the liquid path formation member 116B of each head chip 112B is provided with a plurality of ejection orifices 116*di* (i=1–n, n being integer) arranged, approximately at the middle in terms of the widthwise direction of the liquid formation member 116B, in a straight line in the lengthwise direction of the liquid formation member 116B, with the provision of a predetermined interval PPE between the centers of the adjacent two ejection orifices 116*bi*, as is the liquid path formation member 116A of each head chip 112A. Thus, the liquid path formation member 116B contains the plurality of ink paths leading one for one to the plurality of ejection orifices 116*bi*, and a common liquid chamber. Further, the recording element substrate 114B is provided with a plurality of heater layers correspondent one for one to the plurality of ink paths, a plurality of the aforementioned individual electrode layers, and a plurality of the aforementioned common electrode layers, etc., which are on the surface of the recording element substrate 114B.

Further, each head chip 112B is provided with a plurality of compensatory ejection orifices 116*bm*, which are located across one, or both, end portions of the head chip 112B in terms of the direction in which is the normal ejection orifices 116*a*1 are aligned. More specifically, referring to FIG. 18, the plurality of compensatory ejection orifices 116*bm*, for example, the compensatory ejection orifices 116*bm*1, 116*bm*2, 116*bm*3, 116*bm*4, 116*bm*5, and 116*bm*6, are aligned across the portion of the head chip 112B, which overlaps, in terms of the moving direction of the recording head, with the portion of the head chip 112A between the lengthwise edge and where the second ejection orifice, counting from the same lengthwise edge, of the head chip is. Further, the recording element substrate 114B is provided with a plurality of heater layers, similar to the heater layers for the normal ejection orifices 116*bi*, being positioned corresponding to the plurality of ink paths leading one for one to the compensatory ejection orifices 116*bm*1–116*bm*6.

Referring to FIG. 18, the compensatory ejection orifice 116*bm*1 is positioned so that there is a distance of PPH between its center and the center of the leftmost normal ejection orifice 116*bi*, and also so that the distance PPI between the centers of the adjacent two compensatory ejection orifices 116*bm* in terms of the their alignment direction is approximately half the interval PPE between the center of the adjacent two normal ejection orifices 116*ai* or 116*bi*. Further, the compensatory ejection orifices 116*bm*1–116*bm*6 are made smaller in diameter than the normal ejection orifices 116*bi*.

When a recording operation is carried out by a recording head unit comprising the set of head chips 112A and set of head chips 112B structured as described above, the host computer 70 creates the compensatory data DS, based on the deviation in the positional relationship between a given head chip 112A and the head chip 112B adjacent thereto, as in the above described preceding embodiments. More specifically, each recording head unit is measured with the use of a microscope or the like. Then, for example, when the extension of a referential line JL tangential to one of the normal ejection orifices 116*ai* located oil one of the lengthwise end portions of the head chip 112A is also tangential to, for example, the compensatory ejection orifices 116*bm*3, the compensatory data DS are created so that the compensatory ejection orifices 116*bm*1 and 116*bm*2 are used during a recording operation, in order to prevent the phenomenon that a gap wider than a predetermined value, in terms of the alignment direction of the ejection orifices 116*ai* or orifices 116*bi*, occurs between the ejection orifice of the head chip 112A in contact with the referential line JL, in FIG. 18, and the leftmost normal ejection orifice 116*bi* of the head chip 112B.

On the other hand, if the extension JL', of the referential line JL is tangential to, for example, the compensatory ejection orifice 116*bm*4, as represented by the two-dot chain line, the compensatory ejection orifices 116*bm*1–116*bm*4 are used.

The CPU 74 supplies to the head driver 76, the data obtained by carrying out the above described processes.

While carrying out the above described processes, the CPU 74 also uses the compensatory data DSM, based on the compensatory ejection orifices selected as described above, and read from the RAM 80, and the image formation data, to create a set of data for making the selected compensatory ejection orifices carry out recording operations, and supplies the created data to the head driver 76. Based on these sets of data supplied from the CPU 74, the head driver 76 creates a plurality of sets of drive control pulse signals, and supplies them to the recording head unit.

Figure 19:
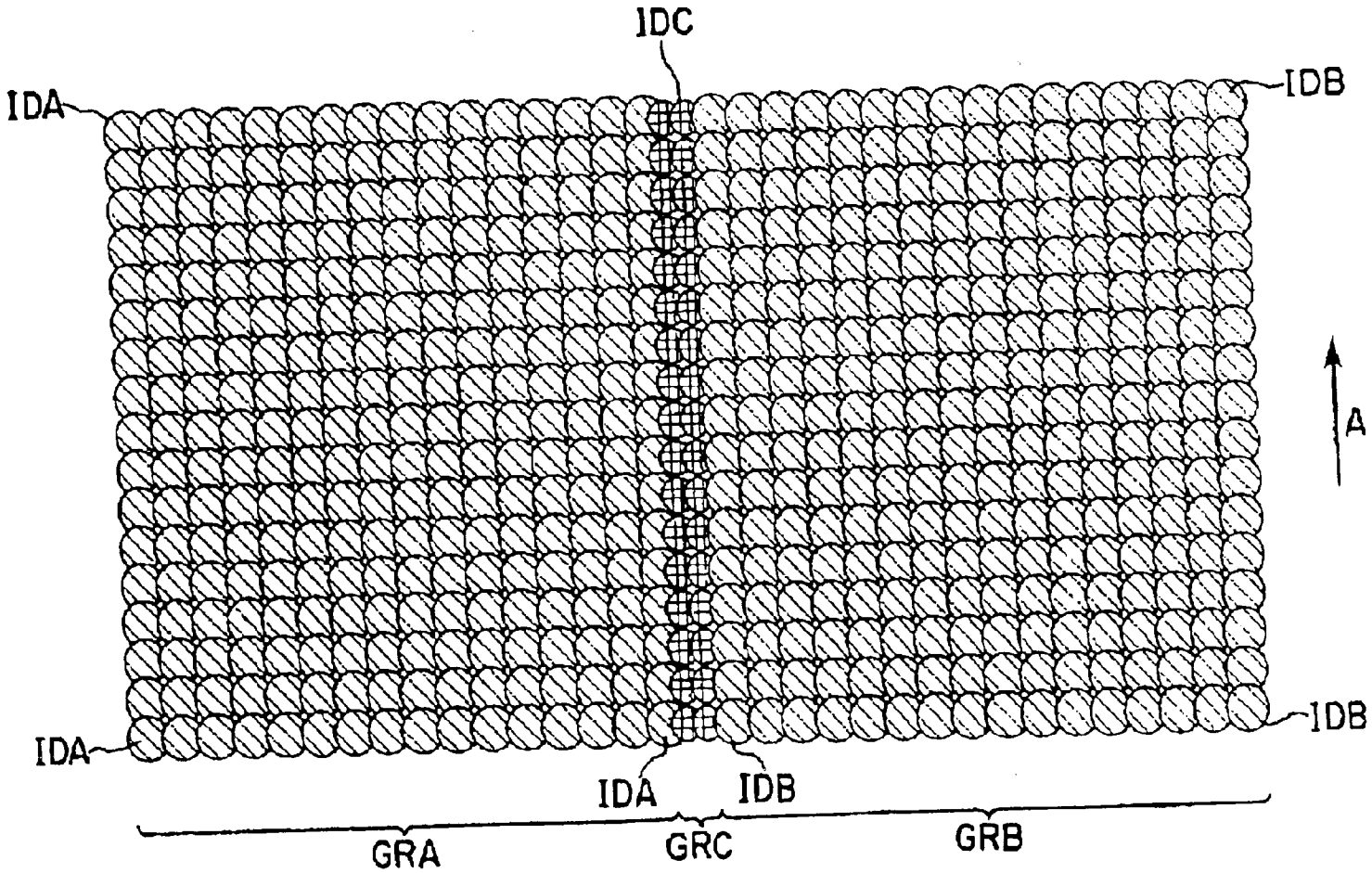
FIG. 19 is a drawing for describing the operation of the head chip shown in FIG. 18.

Thus, as the recording head unit is driven with the controlled timing, an image is formed on the recording surface of the recording paper Pa as shown in FIG. 19, for example.

FIG. 19 shows a part of the image region formed by a single head chip 112A as the head chip 112A was moved in the arrow A direction, and a part of the image region formed by a single head chip 112B as the head chip 112B was moved also in the arrow A direction.

The region GRA is made up of a set of dots IDA formed as the Ink droplets ejected from the head chip 112A adhered to the recording surface of the recording paper Pa, and the region GRB is made up of a set of dots IDB formed by the ink droplets ejected from the head chip 112B as they adhered to the recording surface of the recording paper Pa. The region GRC is made up or a set of dots IDC formed by the ink droplets ejected from the compensatory ejection orifices 116*bm*1 and 116*bm*2 of the head chip 112B as they adhered to the recording surface of the recording paper Pa.

Therefore, it is possible to obtain an image which does not have the so-called white or black streak traceable to the deviation of the positional relationship between the head chip 112A and head chip 112B, across the area correspondent to the range in which the head chip 112A and head chip 112B partially overlap with each other in terms of the moving direction of the carriage, that is, the arrow A direction.

Also in the case of this embodiment, the head design may be such that the compensatory ejection orifices 102*mb* are the same as, or different from, the normal ejection orifices, in terms of ink droplet volume.

(Embodiment 5)

Figure 20:
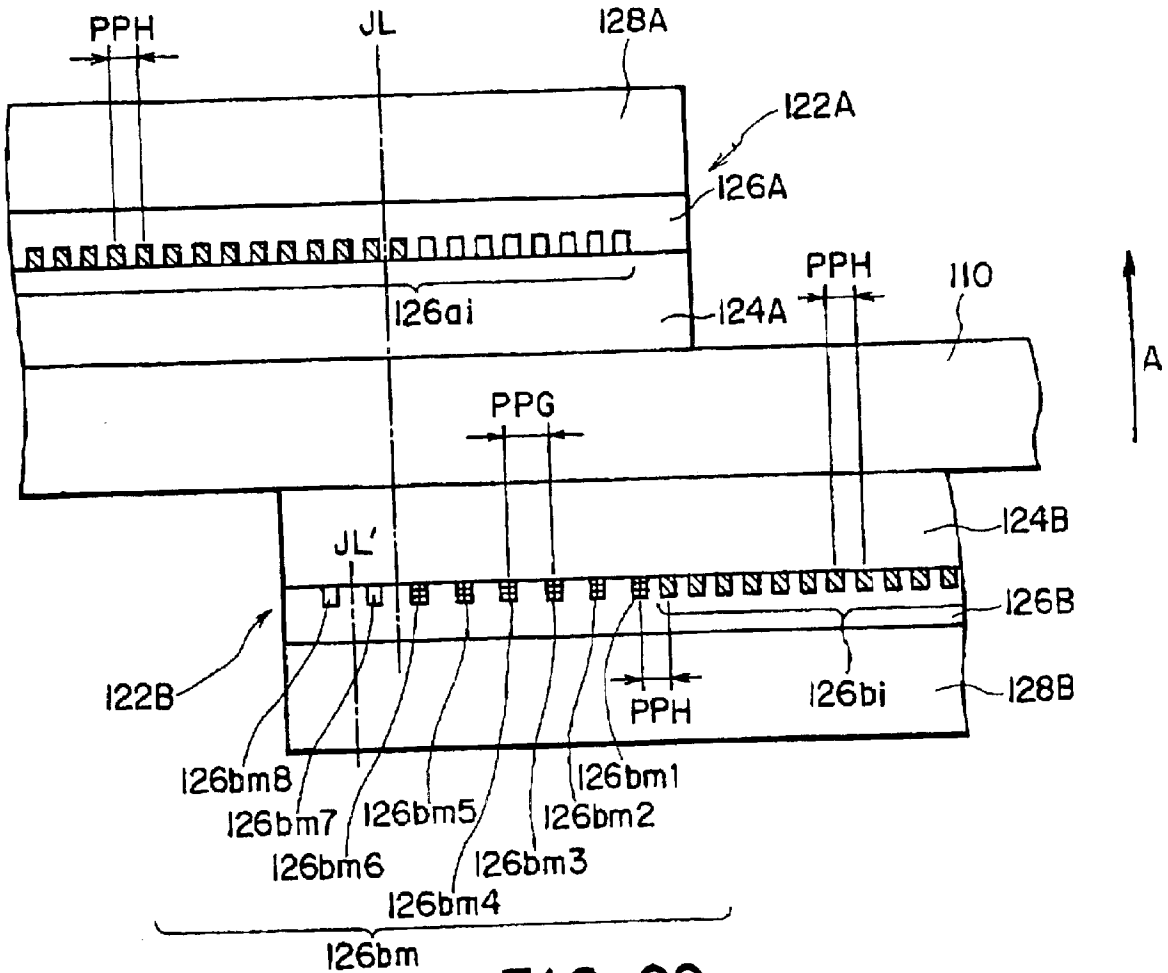
FIG. 20 is a plan view of the essential portion of the fifth embodiment of a recording head in accordance with the present invention, as seen from the outward side of the ejection orifices.

FIG. 20 shows the essential portion of the third embodiment of a recording head in accordance with the present invention.

Like the fourth embodiment, this fifth embodiment in FIG. 20 has a supporting plate 110, a set of head chips 122A arranged on one of the two largest vertical flat surfaces of the supporting plate 110, and a set of head chips 122B arranged on the other of the two largest vertical flat surfaces of the supporting plate 110. The head chips 122A are arranged in a straight line roughly perpendicular to the moving direction of the carriage 40, that is, the direction indicated by an arrow mark A, with the provision of a predetermined interval between adjacent two head chips 122A, and so are the head chips 122A, with the provision of the predetermined interval between the adjacent two head chips 122B. In terms of the ordinal number, inclusive of both sets of the head chips, determined based on the distance from one of the lengthwise ends of the supporting plate 110, the head chips are arranged in the zigzag fashion, with the provision of a predetermined interval between a given head chip 122A and the head chip 122B adjacent thereto. Further, the two sets of head chips 122A and 122B are positioned with the use of a predetermined jig, with a tolerance of approximately ±0.1 mm, for example.

The head chip 122A is similar in internal structure to the head chip 112A of the fourth embodiment described above. The liquid path formation member 126A has a plurality of ejection orifices 126*ai* (i=1–n, n being integer), which are open, being aligned, at one of the end surfaces, with the provision of a predetermined interval PPH between the two adjacent ejection orifices. The head chip 122B is similar in internal structure to the head chip 122A.

Referring to FIG. 18, however, not only is the liquid path formation member 126B of each head chip 122B provided with a plurality of ejection orifices 126*bi* (i=1–n, n being integer) arranged on one of the end surfaces, approximately at the middle in terms of the widthwise direction of the liquid formation member 126B, with the provision of a predetermined interval PPH between the centers of the adjacent two ejection orifice 126*bi*, as is the liquid path formation member 126A of each head chip 122A, but also it is provided with a plurality of compensatory ejection orifices 126*bm*, which are located across one, or both, end portions of the head chip 122B in terms of the direction in which the normal ejection orifices 126*ai* are aligned.

More specifically, referring to FIG. 20, the plurality of compensatory ejection orifices 126*bm*, for example, the compensatory ejection orifices 126*bm*1, 126*bm*2, 126*bm*3, 126*bm*4, 126*bm*5, 126*bm*6, 126*bm*7, and 126*bm*8, are aligned across the portion of the head chip 122B, which partially overlaps, in terms of the moving direction of the recording head, with the portion of the head chip 122A between the right edge and where the twelfth ejection orifice, counting from the same lengthwise edge, of the head chip is.

There is a distance of PPH between the center of the compensatory ejection orifice 126*bm*1 and the center of the leftmost normal ejection orifice 126*bi*. The distance PPG between the centers of the adjacent two compensatory ejection orifices 126*bm* in terms of their alignment direction is greater than the distance PPH. Further, the compensatory ejection orifices 126*bm*1–126*bm*8 are made the same in the area size of their openings as the normal ejection orifices 126*bi*, for example.

When a recording operation is carried out by a recording head unit comprising the set of head chips 122A and set of head chips 122B structured as described above, the host computer 70 creates the compensatory data DS, based on the deviation in the positional relationship between a given head chip 122A and the head chip 122B adjacent thereto, as in the above described preceding embodiments. More specifically, each recording head unit is measured with the use of a microscope or the like. Then, for example, when the extension of a referential line JL, which is the extension of the center line between any two ejection orifices located in one of the lengthwise end portions of the head chip 122A, coincides with, for example, the centerline between the compensatory ejection orifices 122*bm*6 and 122*bm*7, the compensatory data DS are created so that the compensatory ejection orifices 126*bm*1–126*bm*6, which are between the ejection orifice of the head chip 122A next to the referential line JL, and the leftmost normal ejection orifice 126*bi* of the head chip 112B, in FIG. 20, are used during a recording operation. In this case, none of the ejection orifices 126*ai* located in the right portion of the head chip 122A, with respect to the referential line JL, is used.

On the other hand, if the extension JL', of the referential line JL coincides with, for example, the center line between the compensatory election orifices 122*bm*7 and 122*bm*8, as represented by the two-dot chain line, all of the compensatory ejection orifices 126*bm*1–126*bm*7 are used.

The CPU 74 supplies to the head driver 76, the data obtained by carrying out the above described processes.

While carrying out the above described is processes, the CPU 74 also uses the compensatory data DSM, based on the compensatory ejection orifices selected as described above, and read from the RAM 80, and the image formation data, to create a set of data for making the selected compensatory ejection orifices carry out recording operations, and supplies the created data to the head driver 76.

Based on these sets of data supplied from the CPU 74, the head driver 76 creates a plurality or sets of drive control pulse signals, and supplies them to the recording head unit.

Figure 21:
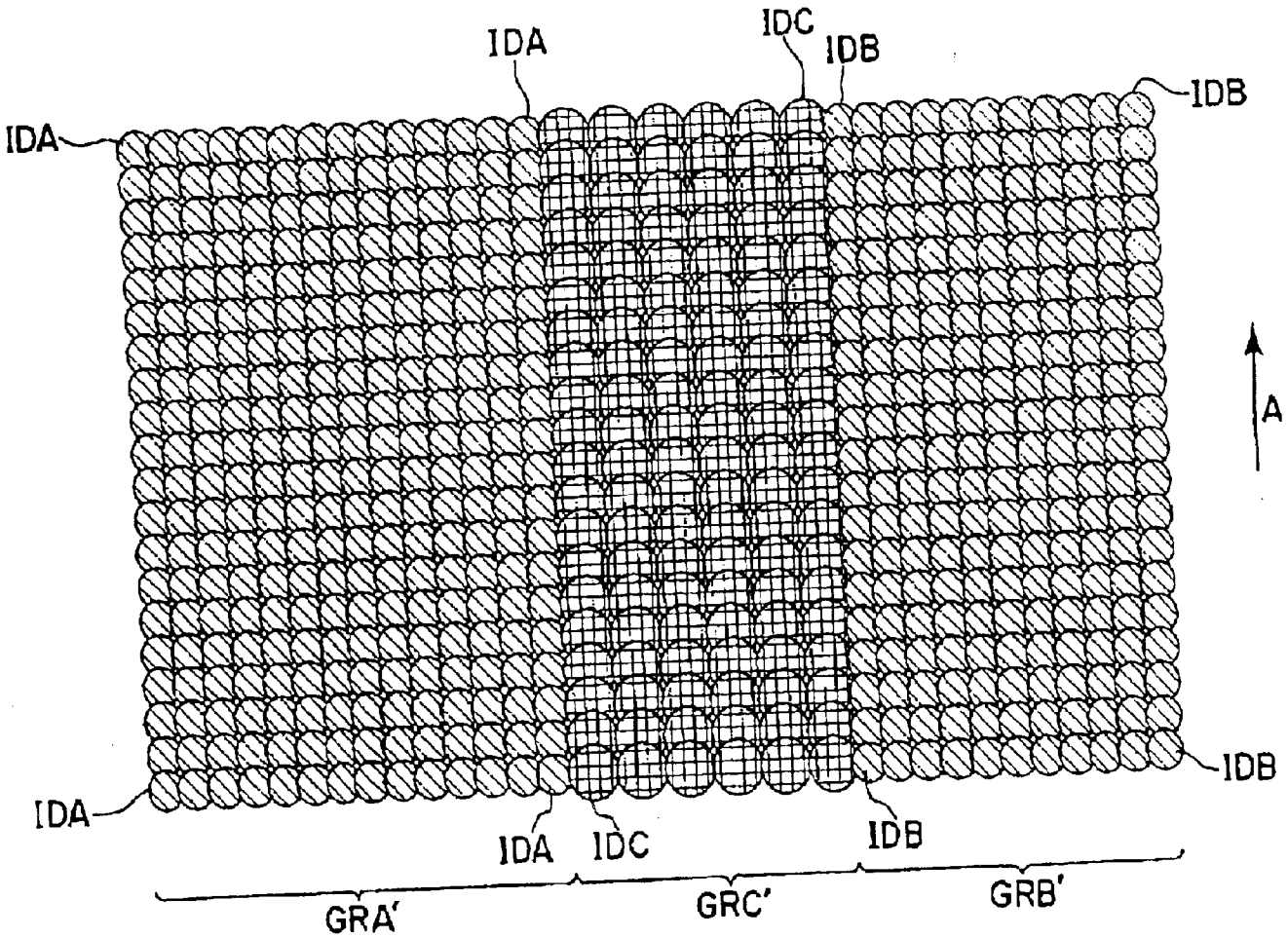
FIG. 21 is a drawing for describing the operation of the head chip in FIG. 20.

Thus, as the recording head unit is driven with the controlled timing, an image is formed on the recording surface of the recording paper Pa as shown in FIG. 21, for example.

FIG. 21 shows a part of the image region formed by a single head chip 122A as the head chip 122A was moved in the arrow A direction, and a part of the image region formed by a single head chip 122B as the head chip 122B was moved also in the arrow A direction.

The region GRA' is made up of a set of dots IDA formed by the ink droplets ejected from the head chip 122A as they adhered to the recording surface of the recording paper Pa, and the region GRB' is made up of a set of dots IDB formed by the ink droplets ejected from the head chip 122B as they adhered to the recording surface of the recording paper Pa. The region GRC' is made up of a set of dots IDC formed by the ink droplets ejected from the compensatory ejection orifices 126*bm*1 and 126*bm*6 of the head chip 122B as they adhered to the recording surface of the recording paper Pa.

Therefore, it is possible to obtain an image which does not have the so-called white or black streak traceable to the deviation of the positional relationship between the head chip 122A and head chip 122B, across the area correspondent to the range in which the lengthwise end portions of the head chip 122A and head chip 122B partially overlap with each other in terms of the moving direction of the carriage, that is, the arrow A direction.

Also in the case of this embodiment, the head design may be such that the compensatory ejection orifices 126*mb* are different from the ejection orifices 126*bi*, in terms of ink droplet volume. When the value of the distance PPE is close to the value of the distance PPG, a desirable image, that is, an image free of density irregularity, can be obtained by not making the compensatory ejection orifices 126*bm* excessively different in ink droplet volume from the ejection orifices 126*bi*.

In this embodiment, if the pitch of the ejection orifices 126*ai* and the pitch of the ejection orifices 126*bi* are set to 600 dpi (PPH=42.5 $\mu$m); the pitch of the compensatory ejection orifices 126*bm* is set to 41.5 $\mu$m; and the deviation in the positional relationship between the two sets of head chips, 10/(42.5−41.5)=10. Thus, the deviation in the positional relationship between the adjacent two (lots formed on the portion of a recording paper corresponding to the portion of a recording head unit where the end portion of one head chip partially overlaps with the end portion of another chip in terms of the moving direction of the recording head can be reduced to less than 1 $\mu$m, with the use of 10 compensatory ejection orifices.

This embodiment was described with reference to such a head design that the pitch of the ejection orifices 126*ai* of each head chip 122A was the same as the pitch of the ejection orifices 126*bi* of each head chip 122B.

However, when the pitch of the ejection orifices 126*ai* of a head chip 122A is very close in value to the pitch of the compensatory ejection, orifices 126*bm* of a head chip 122B, the pitch of the ejection orifices 126*bi* of the head chip 122B may be made equal to the pitch of the compensatory ejection orifices 126*bm*. Such an arrangement can provide the same effects as those described above.

Of course, the present invention includes such an arrangement. As described above, according to this embodiment, the pitch of the head chips in one of the two straight lines, in which they are arranged, is made slightly different from that of the head chips in other line, and the ejection orifices to be used are optimally selected in accordance with head chip usage, making it possible to obtain an image, which is drastically smaller in the irregularities associated with the portion of a recording unit where the end portion of a given head chip in the aforementioned one line, and the end portion of the head chip in the other line, adjacent thereto, overlap with each other, in terms of the moving direction of the recording head unit, compared to an image formed with the use of a conventional recording head unit.

Figure 22:
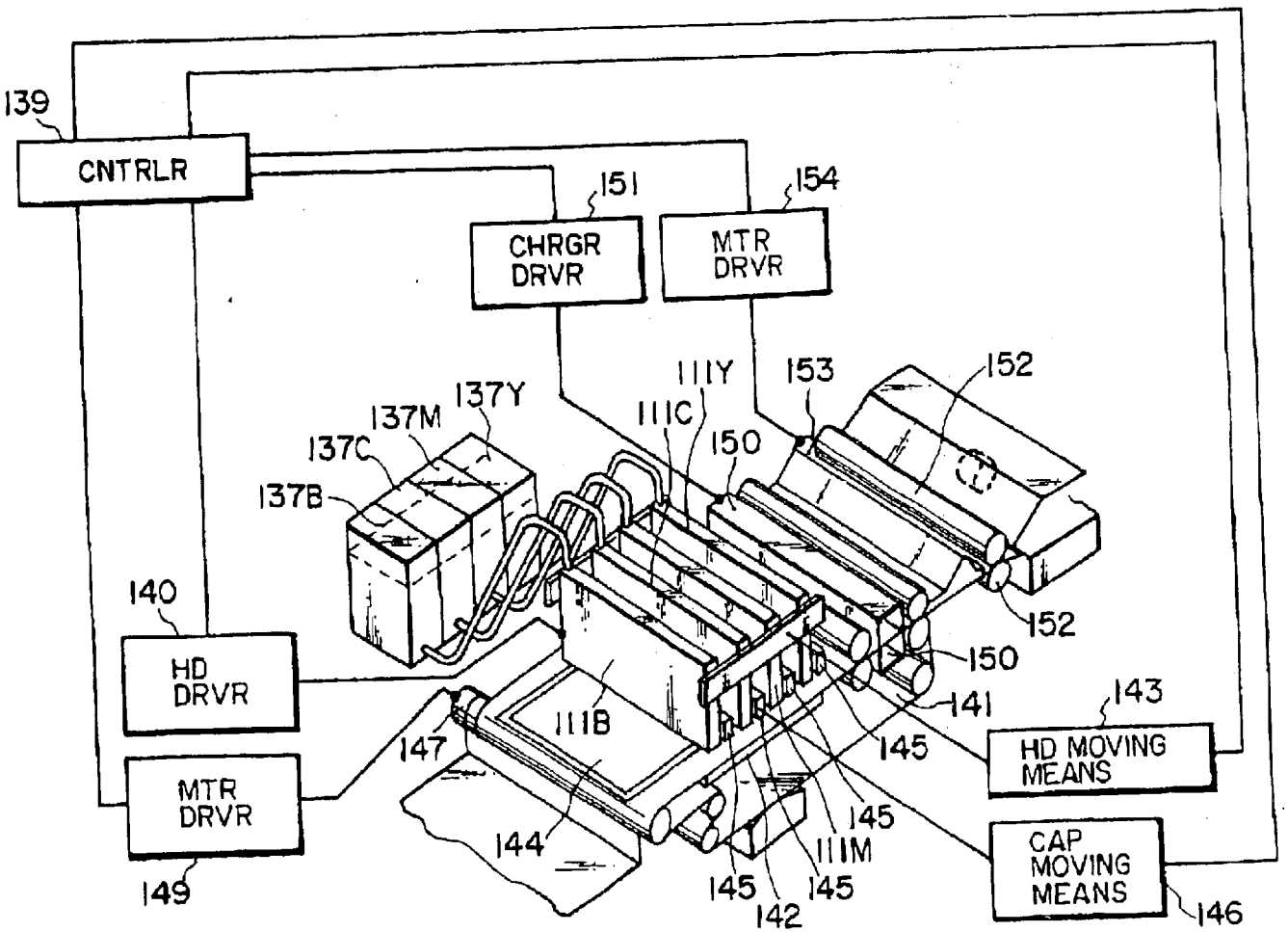
FIG. 22 is a perspective view of another example of a recording apparatus equipped with a recording head in accordance with the present invention, for showing the general structure thereof.
Figure 23:
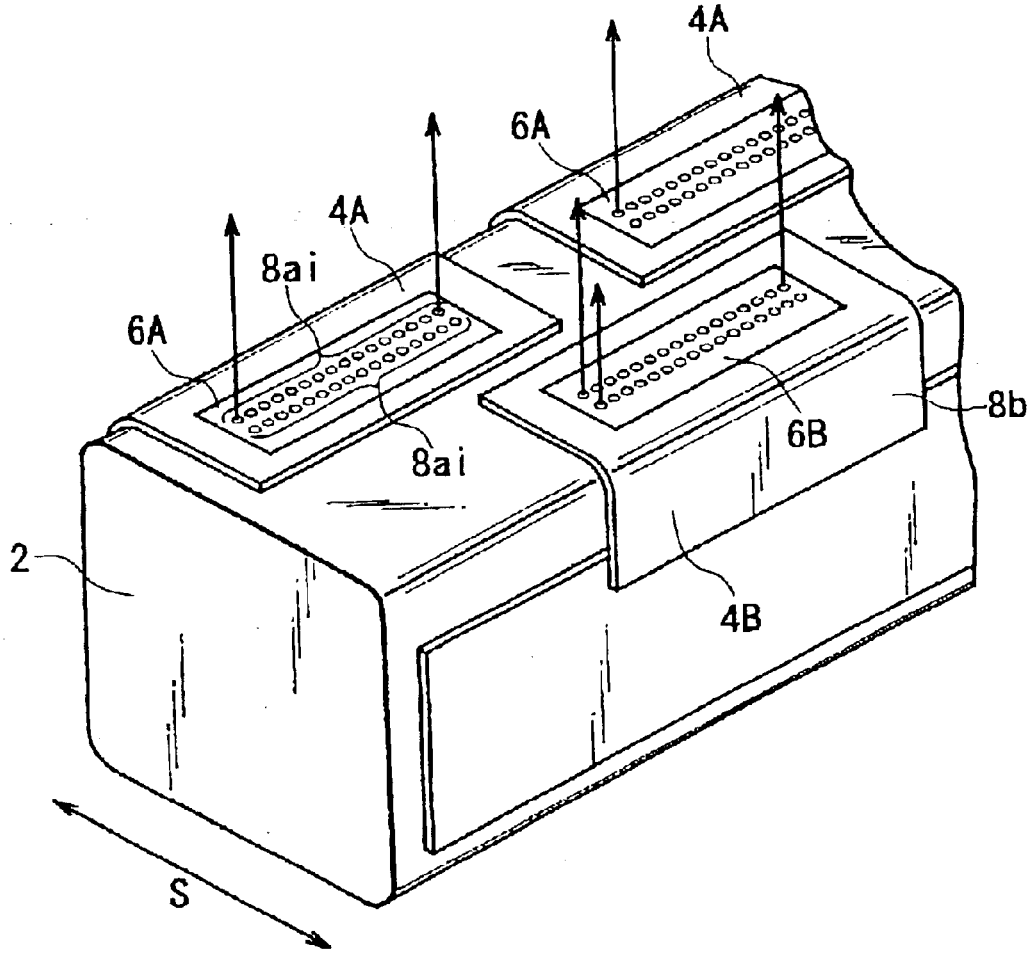
FIG. 23 is a perspective view of a part of a typical conventional recording head of the side shooter type, for showing the structure thereof.
Figure 24:
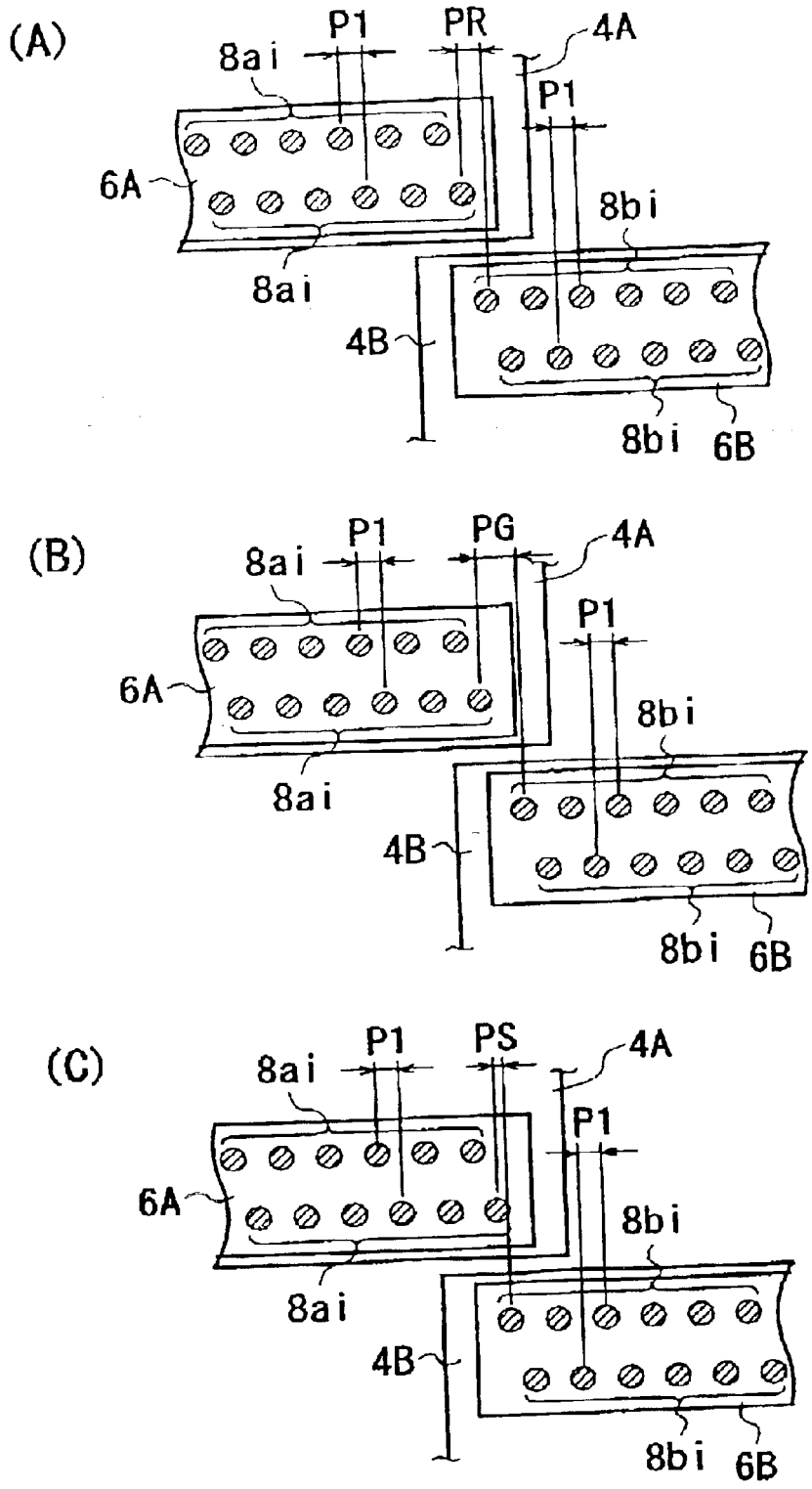
FIGS. 24(A), 24(B), and 24(C) are enlarged plan views of a part of the head chip in FIG. 23.
Figure 25:
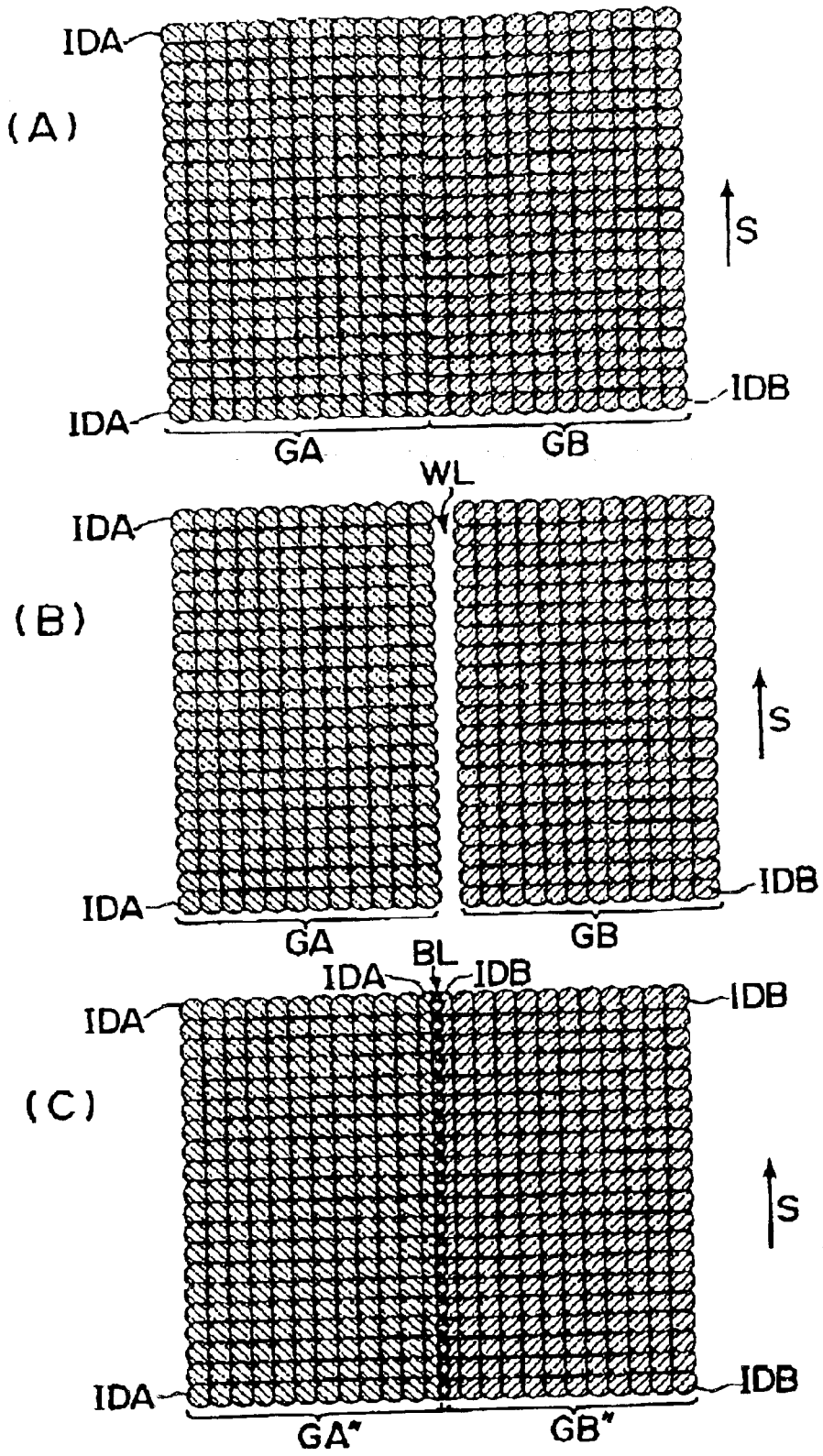
FIGS. 25(A), 25(B), and 25(C) are drawings for describing the operations of the head chips in FIGS. 24(A), 24(B), and 24(C), respectively.
Figure 26:
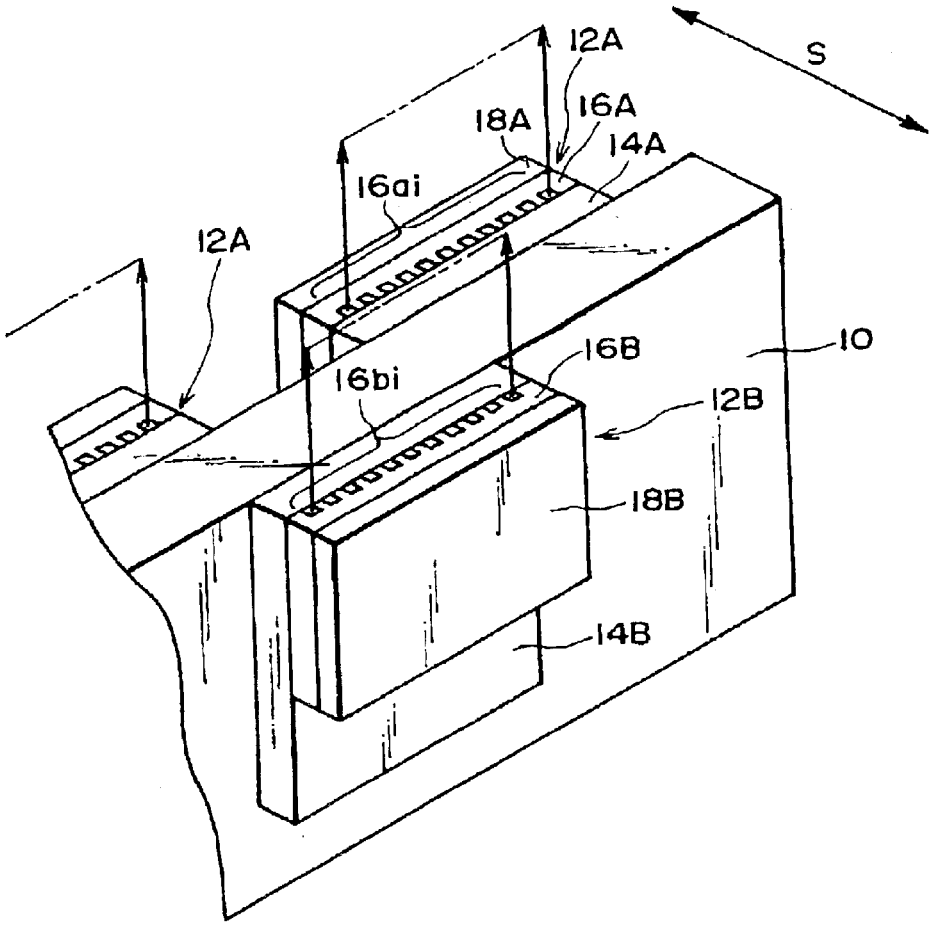
FIG. 26 is a perspective view of a part of a typical conventional recording head of the edge shooter type, for showing the structure thereof.
Figure 27:
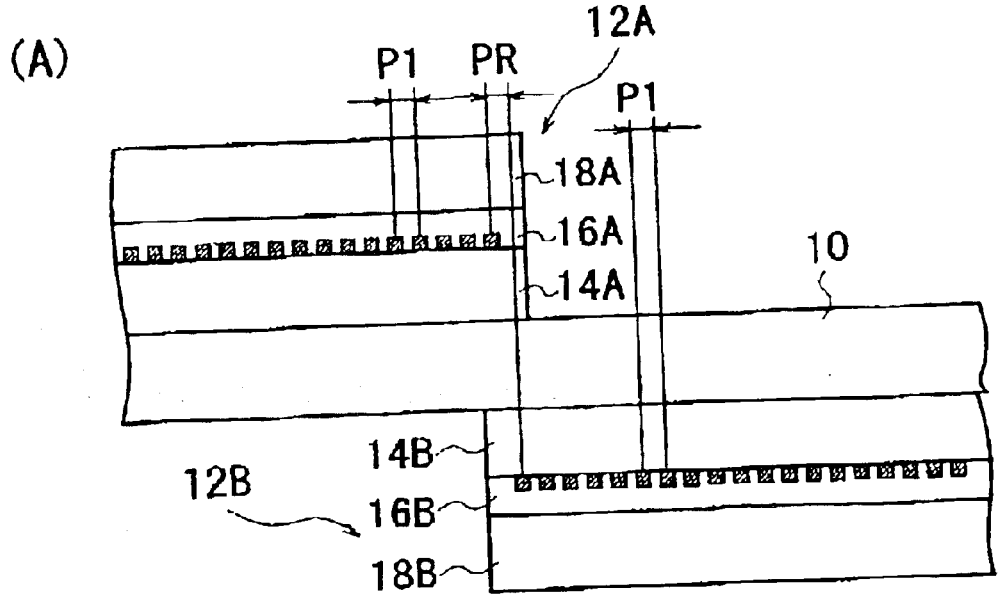
FIGS. 27(A) and 27(B) are enlarged plan views of a part of the head chip in FIG. 26.
Figure 27:
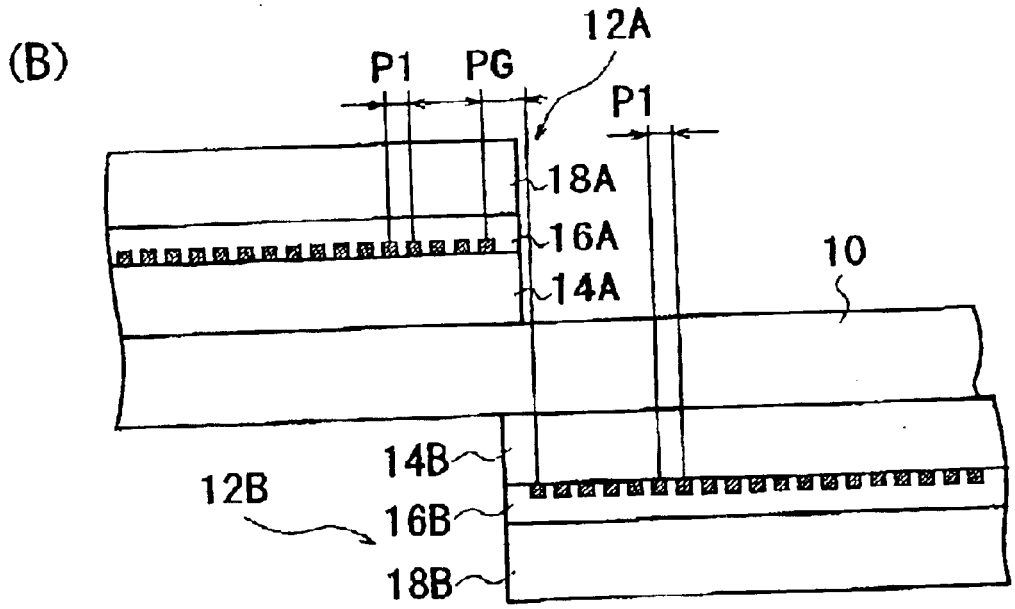
Figure 28:
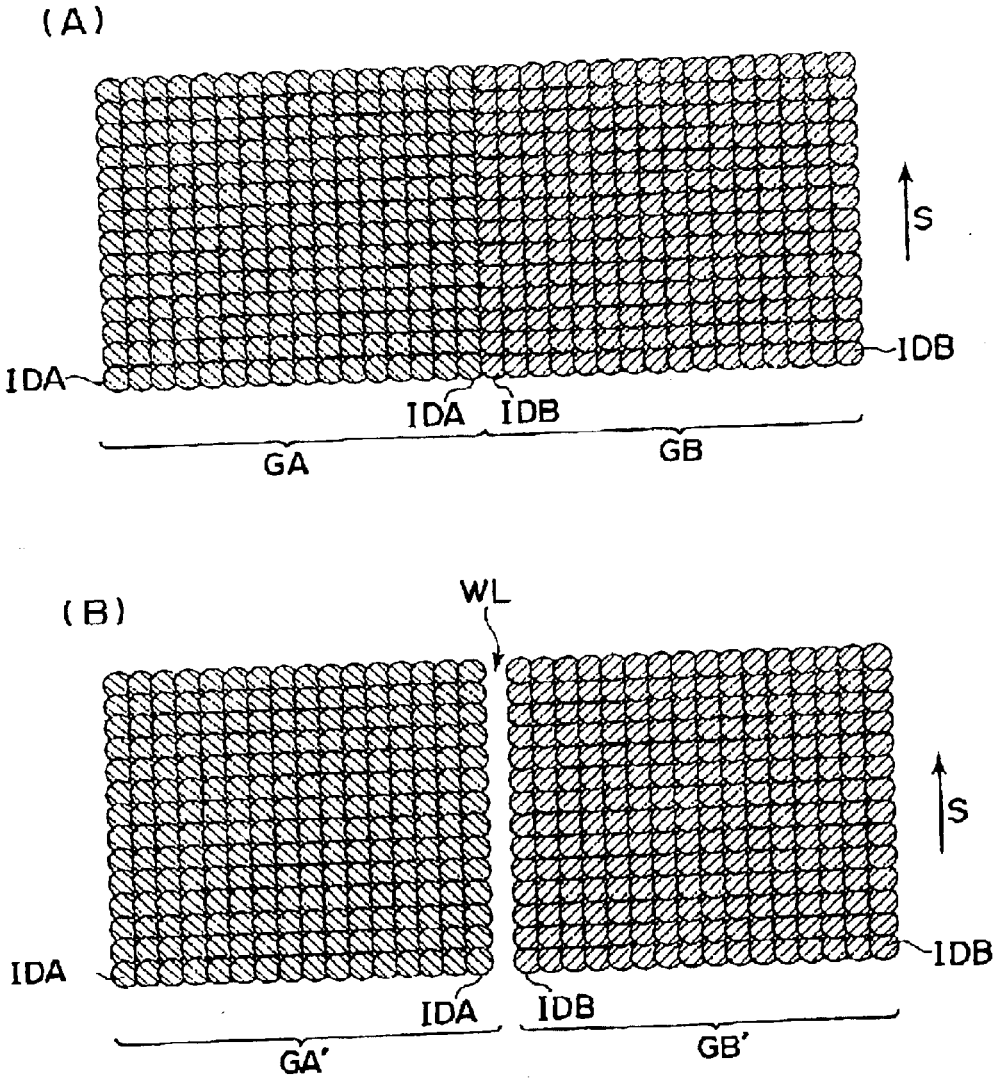
FIGS. 28(A) and 28(B) are drawings for describing the operations of the head chips in FIGS. 27(A) and 27(B), respectively.

FIG. 22 shows the essential portion of another example of a recording apparatus compatible with any of the above described embodiments of a recording head unit in accordance with the present invention, for describing the general structure thereof.

The example of a recording apparatus shown in FIG. 1 is a serial printer, whereas this example of a recording apparatus is a full-line printer. This example of a recording apparatus is also provided with a control block such as the one shown in FIG. 3.

This apparatus has yellow, magenta, cyan, and black ink supply portions 137Y, 137M, 137C, and 137B (which hereinafter will be generically referred to as ink supply portions 137), and four ink jet heads 111Y. 111M, 111C, and 111B (which hereinafter will be generically referred to as ink jet heads 111) connected to the ink supply portion 137, one for one.

Each of the heat-generating resistors (electrothermal transducers) is individually turned on or off by the head driver 40 connected to a controlling apparatus 139. The ink jet heads 111 are arranged in the conveyance direction of a conveyance belt 141, with the provision or predetermined intervals, opposing a platen 142 with the interposition of a conveyance belt 141. They are enabled to be moved vertically, that is, perpendicular to the platen 143, by a head moving means 143 for the recovery process controlled by the controlling apparatus 139. Next to one of the side walls of each ink jet head 111, a head cap 145 for ejecting the bodies of stagnant ink in the ink paths from the ejection orifices, to recover the performance of the ink jet head 111, is disposed, being offset from the ink jet head by half the ink jet head arrangement pitch. In operation, it is moved by a cap moving means 146 controlled by the controlling apparatus 139, so that it is positioned directly below the corresponding ink jet head 111 to catch the waste ink ejected from the ejection orifices 124.

The conveyance belt 141 for conveying a printing paper 144 is wrapped around, being thereby suspended by, a driving roller connected to a belt drive motor 147, Its movement is switched by a motor driver 149 connected to the controlling apparatus 139. On the upstream side of the conveyance belt 141, a charging device 150 is disposed, which charges the conveyance belt to adhere the printing paper 144 to the conveyance belt 141. This charging device 150 is turned on or off by a charging device driver 151 connected to the controlling apparatus 139. To the pair of feeding rollers 152 for feeding the printing paper 144 onto the conveyance belt 141, a motor 153 for rotationally driving this pair of paper feeding rollers 152 is connected. The movement of this motor 153 is switched by a motor driver 154 connected to the controlling apparatus 139.

Thus, before the actual process of printing an image on the printing paper 144 begins, the ink jet heads 111 are moved upward away from the platen 142, and then, the head caps 145 are moved to the positions directly below the ink jet heads 111, one for one, to restore the performance of the ink jet heads 111. After the completion of the ink jet head performance recovery process, the head caps 145 are returned to their original locations, that is, their standby positions. Then, the ink jet heads 111 are moved toward the platen 142, back to their printing positions.

Next, the conveyance belt 141 is driven, with the charging device 150 turned on. Then, the printing paper 144 is fed onto the conveyance belt 141, by the pair of paper feeding rollers 152. Then, an intended image is printed on the printing paper 144 by the ink jet heads 111.

As is evident from the above description of the preferred embodiments of the present invention, according to the present invention, which relates to a recording head unit having two sets of head chips arranged in two straight lines, one for one, and a recording apparatus equipped with such a recording head, each head chip in at least one of the two lines is provided with a single or plurality of compensatory ejection orifices, which are located in one, or both, of the end portions of the head chip, by which the head chip partially overlaps with the end portion of the corresponding head chip in the other line, in terms of the direction perpendicular to the direction in which the head chips are aligned. Therefore, even if the positional relationship between the two sets of head chips in the recording head unit is deviant, it is possible to prevent the formation of an inferior image on the recording surface of recording medium While the invention has been described with reference to the structures disclosed herein, it is not confined to the details set forth, and this application is intended to cover such modifications or changes as may come within the purposes of the improvements or the scope of the following claims.

What is claimed is:

1. A recording head comprising:

a first ejection outlet array having a plurality of ejection outlets for ejecting liquid, said ejection outlets being disposed at predetermined intervals;

a second ejection outlet array having a plurality of ejection outlets for ejecting liquid, said second ejection outlet array extending along a direction in which said first ejection outlet array extends such that said second ejection outlet array is not overlapped with said first ejection outlet array in the direction or a direction perpendicular to the direction, said ejection outlets of said second ejection outlet array being disposed at said predetermined intervals, wherein an end portion of said first ejection outlet array is disposed adjacent to an end portion of said second ejection outlet array; and a plurality of supplementing ejection outlets disposed close to at least one of the end portions of said first ejection outlet array and said second ejection outlet array such that said supplementing ejection outlets are overlapped with another one of the end portions in the direction in which said first ejection outlet array extends, wherein all of said supplementing ejection outlets are disposed at intervals which are smaller than said predetermined intervals at which the ejection outlets of said first and second ejection outlet arrays are disposed.

2. A recording head according to claim 1, wherein said supplementing ejection outlets have opening areas smaller than opening areas of said ejection outlets of said first ejection outlet array and said second ejection outlet array.

3. A recording head according to claim 1, wherein said supplementing ejection outlets eject droplets which are smaller than those ejected from said ejection outlets of said first ejection outlet array and said second ejection outlet array.

4. A recording head according to claim 1, wherein said supplementing ejection outlets are disposed in an interlaced manner as seen in the perpendicular direction.

5. A recording head according to claim 1, wherein a plurality of said plurality of said supplementing ejection outlets are arranged in the perpendicular direction.

6. A recording head according to claim 1, further comprising electrothermal transducers provided for said ejection outlets of said first ejection outlet array, said second ejection outlet array and said supplementing ejection outlets.

7. A recording device comprising:

a recording head comprising:

a first ejection outlet array having a plurality of ejection outlets for ejecting liquid, said ejection outlets being disposed at predetermined intervals;

a second ejection outlet array having a plurality of ejection outlets for ejecting liquid, said second ejection outlet array extending along a direction in which said first ejection outlet array extends such that said second ejection outlet array is not overlapped with said first ejection outlet array in the direction or a direction perpendicular to the direction, said ejection outlets of said second ejection outlet array being disposed at said predetermined intervals, wherein an end portion of said first ejection outlet array is disposed adjacent to an end portion of said second ejection outlet array; and a plurality of supplementing ejection outlets disposed close to at least one of the end portions of said first ejection outlet array and said second ejection outlet array such that said supplementing ejection outlets are overlapped with another one of the end portions in the direction in which said first ejection outlet array extends, wherein all of said supplementing ejection outlets are disposed at intervals which are smaller than said predetermined intervals at which the ejection outlets of said first and second ejection outlet arrays are disposed; and an ejection outlet setting portion for setting a usable part of said supplementing ejection outlets on the basis of a positional deviation between said first ejection outlet array and said second ejection outlet array.

* * * * *

UNITED STATES PATENT AND TRADEMARK OFFICE

CERTIFICATE OF CORRECTION

PATENT NO. : 6,846,064 B2
DATED : January 25, 2005
INVENTOR(S) : Toru Yamane

It is certified that error appears in the above-identified patent and that said Letters Patent is hereby corrected as shown below:

Title page,
Item [57], ABSTRACT,
Line 12, “or” should read -- of --.

Column 1,
Line 67, “examples.” should read -- example. --.

Column 2,
Line 28, “GA. In” should read -- GA in --.
Line 29, “Ink” should read -- ink --.

Column 4,
Line 25, “ill” should read -- in --.

Column 5,
Line 39, “In” should read -- in --.
Line 65, “Is” should read -- is --.

Column 8,
Line 7, “arid” should read -- and --.

Column 12,
Line 27, “mm” should read -- mm. --.

Column 16,
Line 48, “orifices” should read -- orifices. --.

Column 19,
Line 11, “Ink” should read -- ink --.

UNITED STATES PATENT AND TRADEMARK OFFICE

CERTIFICATE OF CORRECTION

PATENT NO. : 6,846,064 B2
DATED : January 25, 2005
INVENTOR(S) : Toru Yamane

It is certified that error appears in the above-identified patent and that said Letters Patent is hereby corrected as shown below:

Column 23,
Line 21, “medium” should read -- medium. --.

Signed and Sealed this

Thirteenth Day of September, 2005

JON W. DUDAS
*Director of the United States Patent and Trademark Office*